US008312579B2

(12) United States Patent
Bock

(10) Patent No.: US 8,312,579 B2
(45) Date of Patent: Nov. 20, 2012

(54) PIVOTING DEVICE

(75) Inventor: Klaus Bock, Verl (DE)

(73) Assignee: Hermann Bock GmbH (DE)

( * ) Notice: Subject to any disclaimer, the term of this patent is extended or adjusted under 35 U.S.C. 154(b) by 861 days.

(21) Appl. No.: 12/227,745

(22) PCT Filed: May 8, 2007

(86) PCT No.: PCT/EP2007/004032

§ 371 (c)(1),
(2), (4) Date: Feb. 11, 2009

(87) PCT Pub. No.: WO2007/137678

PCT Pub. Date: Dec. 6, 2007

(65) Prior Publication Data

US 2009/0235456 A1 Sep. 24, 2009

(30) Foreign Application Priority Data

May 26, 2006 (DE) ..... 20 2006 008 523 U
Nov. 28, 2006 (DE) ..... 20 2006 018 156 U

(51) Int. Cl.
*A47B 7/02* (2006.01)

(52) U.S. Cl. ..... 5/613; 5/616

(58) Field of Classification Search ..... 5/613, 610, 5/616–618, 620, 37.1, 42.1; 108/7, 20, 166; 297/330, 362.11, 362.12, 452.2; 403/303
See application file for complete search history.

(56) References Cited

U.S. PATENT DOCUMENTS

| | | | | |
|---|---|---|---|---|
| 5,023,967 | A | 6/1991 | Ferrand | |
| 5,063,623 | A * | 11/1991 | Bathrick et al. | 5/616 |
| 5,660,443 | A * | 8/1997 | Pedronno | 297/452.2 |
| 5,711,577 | A * | 1/1998 | Whalen | 297/452.2 |
| 6,058,532 | A * | 5/2000 | Allen | 5/509.1 |
| 6,739,004 | B1 | 5/2004 | Abrahamsen et al. | |
| 6,893,092 | B1 * | 5/2005 | Krambeck | 297/362.11 |
| 7,395,568 | B2 * | 7/2008 | Damewood | 5/722 |
| 2005/0055779 | A1 | 3/2005 | Damewood | |
| 2005/0248198 | A1 | 11/2005 | Fowler et al. | |

FOREIGN PATENT DOCUMENTS

DE 203 08 887 U1 10/2004

(Continued)

OTHER PUBLICATIONS

International Preliminary Report on Patentability for International application No. PCT/EP2007/004032 mailed Feb. 26, 2009.

(Continued)

*Primary Examiner* — Robert G Santos
*Assistant Examiner* — Nicholas Polito
(74) *Attorney, Agent, or Firm* — Harness, Dickey & Pierce, P.L.C.

(57) ABSTRACT

A pivoting device for pivoting of segments (4) which are pivotable relative to one another of a bearing construction (2), providing a bearing surface (3) for a mattress, a cushioning element or the like, of an item of furniture for sitting and/or lying on, in particular a bed. In order to produce a pivoting device which requires a comparatively small installation space while also having safe operation, the invention proposes a pivoting device which includes an electromotive drive device (13) which is arranged on the end face between two neighboring segments (4).

20 Claims, 43 Drawing Sheets

FOREIGN PATENT DOCUMENTS

| | | | |
|---|---|---|---|
| DE | 20 2004 018 913 | U1 | 8/2005 |
| EP | 0 935 937 | B1 | 8/1999 |
| EP | 1020171 | A1 | 7/2000 |
| JP | 5-55937 | U | 7/1993 |
| JP | 2003-508141 | A | 3/2003 |
| RU | 2200448 | | 3/2003 |
| RU | 2 261 695 | | 9/2003 |
| RU | 2265764 | | 12/2005 |
| WO | WO-01/17401 | A1 | 3/2001 |
| WO | WO-02/055001 | A1 | 7/2002 |
| WO | WO-2004/107923 | A1 | 12/2004 |

OTHER PUBLICATIONS

Decision to Grant a Patent for Russian Application No. 2008-151373/12 (067455) with English Translation of Russian Search Report dated Oct. 5, 2011 (7 pages).

* cited by examiner

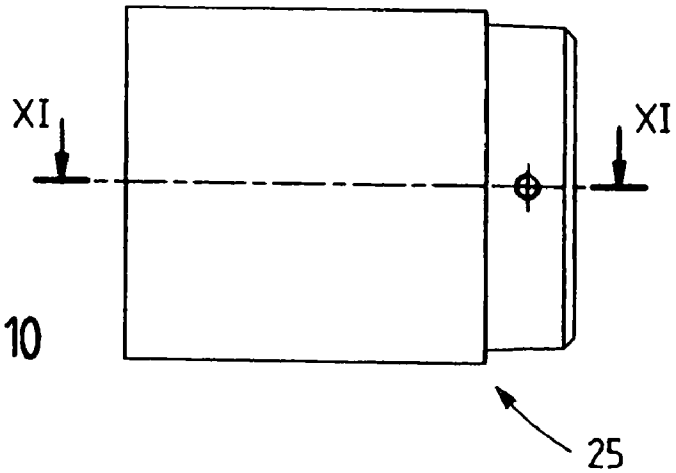
Fig. 10
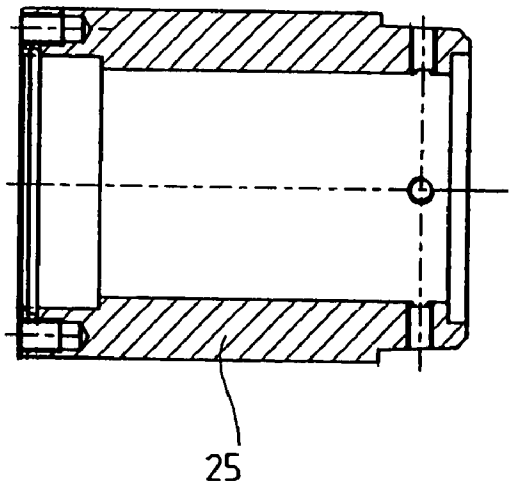
Fig. 11
Fig. 9
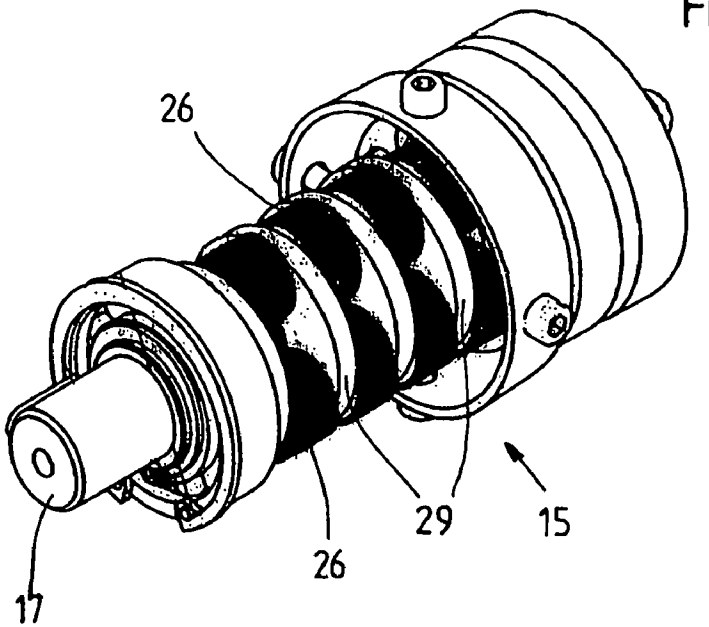
Fig. 12
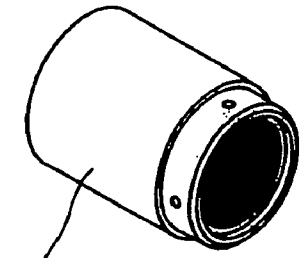

PIVOTING DEVICE

The present invention relates to a pivoting device for pivoting of segments which are pivotable relative to one another of a bearing construction, providing a bearing surface for a mattress, a cushioning element or the like, of an item of furniture for sitting and/or lying on, in particular a bed.

Beds per se are well known in the art. For this reason is not necessary to support this fact at this point by citing documents.

For supporting a mattress, a cushioning element or the like as intended, beds which are known from prior art have a bearing construction providing a bearing surface for the mattress, the cushioning element or the like. Such a bearing construction can be formed for instance by a lattice, a slatted base or the like. Particularly slatted bases have delivered an optimal performance in daily use as a bearing construction for a mattress, a cushioning element or the like. They are normally comprised of a frame which carries the slats of the slatted base, and the slats can be designed as resilient slats made of plastic, wood or the like.

To provide an option to a user for adjusting a desired sitting and/or lying position, slatted bases are known from prior art which consist of individual segments which are pivotable relative to one another. Normally, these segments of a pivotable slatted base are carried by a supporting frame.

An adjustable slatted base as known from prior art typically comprises a central or seat part which is received by a supporting frame. To one end of this seat part a head part is connected in an articulated manner, so that the head part can be pivoted relative to the central part. A foot part is connected in an articulated manner to the other end of the central part, so that the slatted base is comprised of totally three segments. It is further known from prior art to again subdivide the foot part in two segments which are pivotable relative to one another. According to this embodiment, the slatted base is comprised of totally four segments.

It is known from prior art to pivot the mutually pivotable segments of a slatted base by means of an electric motor. For this purpose, beds which are known from prior art are equipped with electric motors which are arranged under the bearing construction, i.e. under the slatted base. Preferably, these motors can be operated by a wired remote control. The individual segments of the bearing construction, i.e. of the slatted base, are coupled to the electric motors by respective connecting rods which are provided under the segments, so that the position of the segments in relation to one another can be pivoted as desired, by the connecting rods which are provided for this purpose, when the electric motors are operated.

Although the above-described construction has delivered good performance in daily use, there are a few drawbacks. The electric motors and the connecting rods for instance which are arranged under the segments require a certain installation space, so that the entire bed construction must have a considerable height which is opposed particularly to customers' requests for low beds that offer easy entry. But additionally, these connecting rods include a certain risk of injury and hence a safety risk, because objects and not least extremities may become pinched between the movable parts of the connecting rods during movement thereof. Incidentally, the optical appearance of these known constructions is relatively poor, because particularly in the pivoted state of some segments the connecting rods below these segments are exposed.

In view of the above-described drawbacks, it is an object of the present invention to provide a pivoting device which only requires a small installation space and at the same time ensures safe operation.

According to the present invention, this object is achieved by a pivoting device for pivoting of segments which are pivotable relative to one another of a bearing construction, providing a bearing surface for a mattress, a cushioning element or the like, of an item of furniture for sitting and/or lying on, in particular a bed. The pivoting device includes an electromotive drive device which is arranged on the end face between two neighboring segments.

Differently from constructions which are known from prior art, the drive device according to the pivoting device of the invention is arranged on the end face between two neighboring segments, whereby the space under the bearing construction, i.e. under the segments, remains free, so that an overall low-height bed construction is obtained.

Between the two neighboring segments a drive device is arranged on each end face. Thus, two neighboring segments are each connected to a common pivoting device. In the case of four segments for instance, the invention provides a total number of three pivoting devices, a first pivoting device being arranged between a first and a second segment, a second pivoting device being arranged between the second and a third segment, and a third pivoting device being arranged between the third and a fourth segment. The segments which are each coupled by means of a pivoting device according to the present invention are adapted for pivoting in relation to one another, so that all in all a bearing construction is provided which consists of segments that can be pivoted in their position relative to one another individually and so as to suit the needs.

The drive device of a pivoting device includes an electric motor and a gear transmission flanged to the motor. An axial drive device is preferred. For reasons of safety and not least for optical reasons, the motor and the gear transmission are accommodated inside a housing.

A shaft which is supported for rotation is flanged to the power output side of the gear transmission of a drive device. Preferably, this shaft is comprised of two semi-shafts, and the gear transmission is substantially disposed centrally between these two semi-shafts. Also for reasons of safety, i.e. for protecting the user during the rotation of the semi-shafts, the same extend within a housing, i.e. are supported for rotation inside the housing. Each of the two semi-shafts of a pivoting device carries on one end thereof a fixing flange which serves to connect one of the two segments which are coupled to the pivoting device to said pivoting device.

The drive device of a pivoting device is connected to a fixed bearer element. The bearer element preferably consists of two segments, and the drive device is mainly arranged between the two segments. Each of the two segments carries a neck flange on its end serving to connect the other one of the two segments which are coupled to the pivoting device, to said pivoting device.

According to a particular advantage of the present invention, the two segments of the bearer element are formed by the housing which accommodates the respective semi-shafts, whereby a compact and space-saving overall construction is obtained.

The pivoting device according to the invention comprises one driving device in total. This driving device on its part includes an electric motor and a gear transmission connected to the electric motor, a fixed bearing element consisting of two segments, and a shaft which is composed of two semi-shafts and flanged to the gear transmission of the drive device.

The motor and the gear transmission of the drive device are accommodated inside a housing, just as the semi-shafts which are supported for rotation and flanged to the gear transmission of the drive device. In a preferred manner, the housing which surrounds the semi-shafts constitutes the bearer element which is rigidly connected to the drive device. The entire assembly of the pivoting device is disposed on the face side between two mutually pivotable segments of the bearing construction. For this purpose, the semi-shafts supported for rotation each carry fixing flanges on the one end side, and the segments of the bearer element each carry neck flanges on the one end side. The fixing flanges serve for the arrangement of a first segment on the pivoting device, whereas the neck flanges serve for the arrangement of a second segment on the pivoting device. All in all, this provides for a construction in which a pivoting device is disposed between two segments which are arranged for pivoting in relation to one another and is connected to these segments, and these segments can be moved relative to one another by this pivoting device through an electric motor. Both the drive device of the pivoting device and the components transmitting the pivoting power to the segments, i.e. the segments of the bearer element and the semi-shafts of the driving shaft, are arranged in a space-saving manner on the face side between the segments. Advantageously, connecting rods which are arranged under the segments as in prior art, can be omitted. Thus, the pivoting device according to the present invention is extremely space-saving concerning its installation, and it also offers safety-related advantages, because the entire construction unit constituting the pivoting devices is encapsulated.

The semi-shafts of the pivoting device define the pivoting shaft about which the segments which are connected to the pivoting device can be pivoted relative to one another. The semi-shafts and hence the pivoting device as such are aligned transversely with respect to the pivoting movement of the segments.

According to a special proposal of the invention, at least one of the segments which are connected to a pivoting device is arranged on the pivoting device for relative displacement in a direction transversely to the longitudinal extension of the semi-shafts of the pivoting device. The purpose of this arrangement is that in the course of the pivoting movement, this segment which is arranged for relative displacement on the pivoting device is moved either towards or away from the pivoting device, depending on the pivoting direction. This construction provides for a length adjustment which is necessary for compensating the variation of the length of a mattress, a cushioning element or the like, placed on the bearing construction. This variation is inevitably caused by a bead or bulging of a mattress or cushioning element in the region of the pivoting shaft between two segments.

The invention also proposes a bed, in particular a hospital and/or nursing bed having a bearing construction, providing a bearing surface for a mattress, a cushioning element or the like. The bearing construction is composed of segments which are pivotable relative to one another, said bed being characterized by a pivoting device of the above-described type.

Preferably, one of the two segments which are coupled to each other through the pivoting device is arranged for relative displacement on the pivoting device, so that a length adjustment for the bearing surface which is provided by the bearing construction can take place during a pivoting movement. In this way, a variation of length of a mattress or cushioning element placed on a bearing surface of the bearing construction can be compensated. This variation is caused by a bead or bulging of the mattress or cushioning element in the region of the pivoting shafts of the segments during the pivoting movement.

Further features and advantages of the invention will become apparent from the following description of the drawing figures. It shown by:

FIG. 1 a schematic perspective view of a detail of a bed;

FIG. 2 a schematic lateral view of the illustration according to FIG. 1;

FIG. 3 a schematic perspective view of the pivoting device according to the present invention;

FIG. 4 to 20 a partially schematic representation of a first embodiment of the pivoting device according to the present invention;

FIG. 21 to 36 a partially schematic representation of a second embodiment of the pivoting device according to the present invention;

FIG. 37 to 43 a partially schematic representation of a third embodiment of the pivoting device according to the present invention;

FIG. 44 a schematic representation of a fourth embodiment of the pivoting device according to the present invention;

FIG. 45 a schematic representation of a fifth embodiment of the pivoting device according to the present invention;

FIG. 46 to 50 a partially schematic representation of a sixth embodiment of the pivoting device according to the present invention;

FIG. 51 to 60 a partially schematic representation of a further embodiment of the pivoting device according to the present invention; and FIG. 61 to 68 a partially schematic representation of an embodiment of the present invention including a double motor.

FIG. 1 schematically illustrates in perspective view the bearing construction 2 of a bed 1. The bearing construction 2 is configured as a slatted base and provides a bearing surface 3 serving to support a mattress, a cushioning element or the like.

The bearing construction 2 illustrated in the FIG. 1 can be supported in a height-adjustable fashion by a bearer frame not shown which is supported in turn by load-bearing rollers. The bearing construction 2 as such is designed as a slatted base and comprises segments 4 which are pivotable relative to one another. The segments are carried by a supporting frame 9. Each segment 4 is comprised of a frame 5, and each frame 5 is comprised of frame parts 6 which are connected to each other by means of connectors 7. The slats 8 of the slatted base are supported by the respective frame 5. The slats 8 can be made for instance of wood, plastic or the like.

The supporting frame 9 of the bearing construction 2 also consists of frame parts 10 which are connected to each other by means of corresponding connectors 11. Both the frame parts 6 of the frames 5 and the frame parts 10 of the supporting frame 9 can be made of aluminum, for example in the form of extruded aluminum parts. The connectors 7 or 11 connecting the frame parts 6 or 10 are also made of aluminum, but it is also possible to use a plastic material for fabricating the connectors 7 or 11.

The central segment 4, i.e. the second segment 4 from the left with respect to the drawing plane according to FIG. 1, is connected in a stationary fashion to the supporting frame 9. A pivoting device 12 (still to be described in more detail) according to the invention is flanged to the front face of the segment 4 on both sides. With reference to the sheet plane according to FIG. 1, a second segment 4 joins the central segment 4 to its left. This second segment 4 can be also be referred to as head part. The segment 4 which serves as a head part and the segment 4 which serves as a central part are pivotable in relation to one another, by means of the pivoting device 12 interposed there between.

The segment 4 which is referred to as central part is joined to its right with respect to the drawing plane according to FIG. 1 by two additional segments 4. These segments 4 are each arranged on the segment 4 which is disposed on the left side with regard to the drawing plane according to FIG. 1, so that they can be pivoted each in relation to this segment by the interposition of a pivoting device 12 according to the invention. All in all, a bearing construction 2 is formed which comprises four segments 4, and the individual segments 4 are pivotable in relation to one another thanks to these two pivoting devices 12 which are each arranged between to neighboring segments 4.

FIG. 2 illustrates the bearing construction according to FIG. 1, in a schematic lateral view. From this illustration, too the individual segments can be seen, which are adapted for pivoting in relation to one another, thanks to the pivoting device 12 which is interposed between two neighboring segments each.

The pivoting device 12 which is arranged between two segments each is schematically illustrated in the FIG. 3.

As shown by the FIG. 3, a pivoting device 12 each comprises a drive device 13 which is disposed on the face side between two neighboring segments—as already explained in connection with the FIGS. 1 and 2. The drive device 13 comprises a motor 14 and a gear transmission 15. The motor 14 and the gear transmission 15 are accommodated in a housing 16 which preferably is in a two-part configuration from plastic.

A Shaft 17 is flanged to the power output side of the gear transmission 15. In the embodiment according to FIG. 3, the shaft is composed of two semi-shafts 18 and 19, and the gear transmission 15 is mainly disposed centrally between the two semi-shafts 18 and 19.

The semi-shafts 18 and 19 each carry on the end side thereof a fixing flange 21 which serves to couple one of the two neighboring segments 4 to the pivoting device 12. These fixing flanges 12 are preferably designed as stud links that can be pushed into the hollow frame parts 6 of the frame 5 and fixed therein.

FIG. 3 further shows that the drive device 13 is connected to a fixed bearer element 22. This bearer element 22 is composed of two segments 23, and the drive device 13 is arranged mainly centrally between these two segments 23.

Preferably, these segments 23 each constitute a housing 20 in which the respective associated semi-shafts 18 or 19 are supported for rotation.

The segments 23 each carry on one end thereof a neck flange 24, by which the pivot device 12 can be mounted to a second segment. The neck flanges 24 just as the fixing flanges 21 are preferably formed as stud links which can be pushed into the hollow frame parts of the associated frame 5 of the segment 4 and fixed there, for arranging a segment 4 on the pivot device 12.

The pivot device 12 serves to interconnect two segments 4 for pivoting in relation to one another. The fixing flanges 21 serve for arranging the first segment, whereas the neck flanges 24 are provided for arranging the second segment. Upon operation of the pivoting device, the fixing flanges 21 are relatively pivoted with respect to the neck flanges 24, whereby the segment 4 supported by the fixing flanges 21 is relatively pivoted with respect to the segment 4 supported by the neck flanges 24.

The pivoting device 12 as illustrated in FIG. 3 is disposed on the face side between two neighboring segments 4, as it can be seen from the FIGS. 1 and 2, thus achieving a particularly space-saving design of the entire bed construction. Any additional connecting rods like those known from prior art are not required.

Thanks to the encapsulated design of the pivot device the same is protected against splash water. The drive device 13 is preferably operated by means of a remote control which can be of the wired type or wireless type. Preferably, one of the two segments which are coupled through a common pivoting device 12 are arranged for longitudinal displacement with respect to the pivot device 12, so that a variation of length is possible with respect to the bearing surface 3 provided by the segments 4. Accordingly, a variation of length of the mattress placed on the bearing surface 3 occurring as a result of a pivoting movement can be compensated.

The basic principle of the pivot device according to the present invention has been explained above with reference to the schematic illustrations in the FIGS. 1, 2 and 3. In the following, the pivot device according to the invention will be discussed by way of exemplary embodiments. A first embodiment is shown in the FIGS. 4 to 20, a second embodiment in the FIGS. 21 to 36, a third embodiment in the FIGS. 37 to 43, a fourth embodiment in the FIG. 44, a fifth embodiment in the FIG. 45, a sixth embodiment in the FIG. 46 to 50, and a further embodiment in the FIGS. 51 to 60. In these figures, same and/or similar parts are identified by the same reference numbers.

FIG. 4 shows in a first embodiment a drive device 13 which comprises a motor 14 and a gear transmission 15. The motor 14 and the gear transmission 15 are each accommodated in a housing.

FIG. 5 shows in particular the structure of the gear transmission 15.

Figure 1:
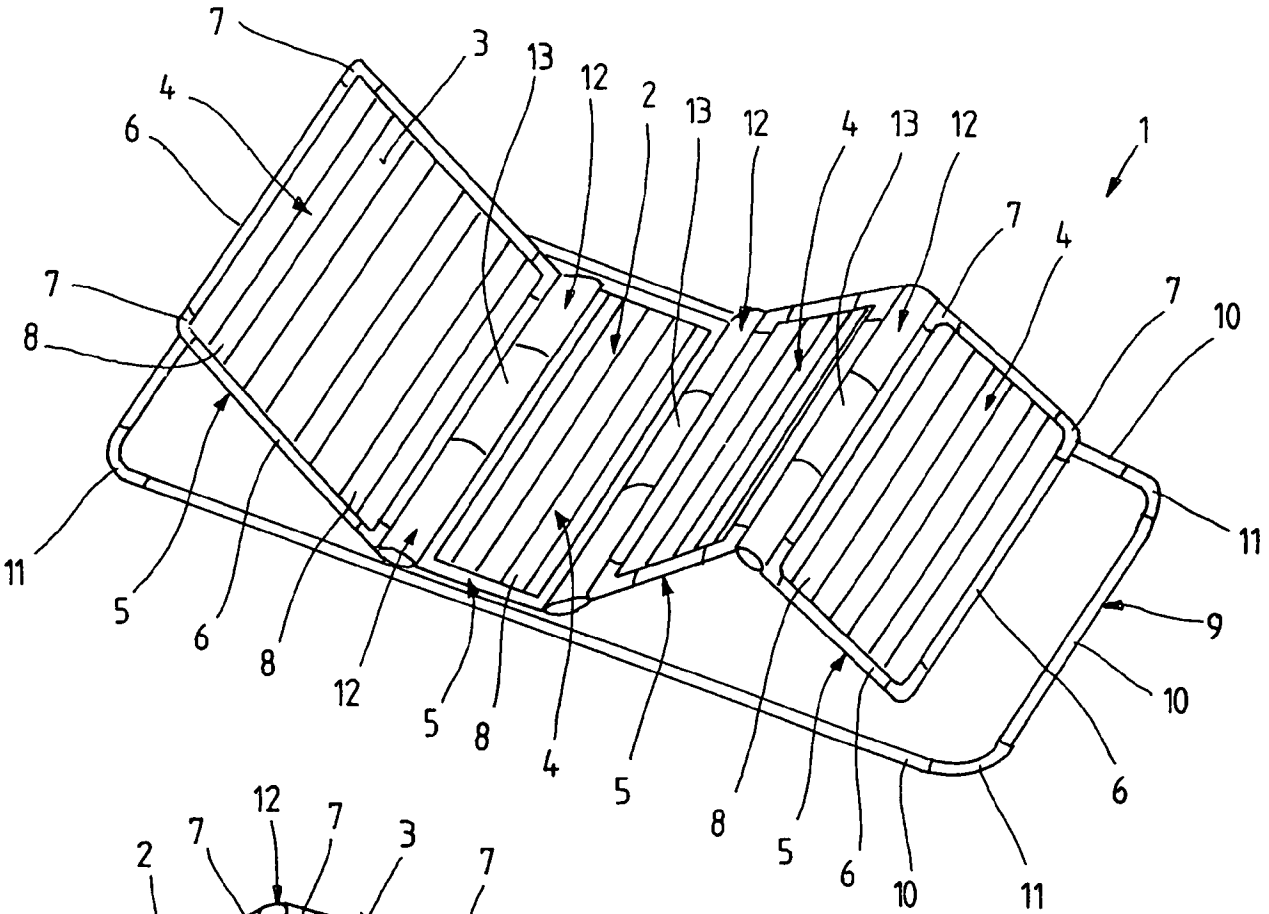
Figure 2:
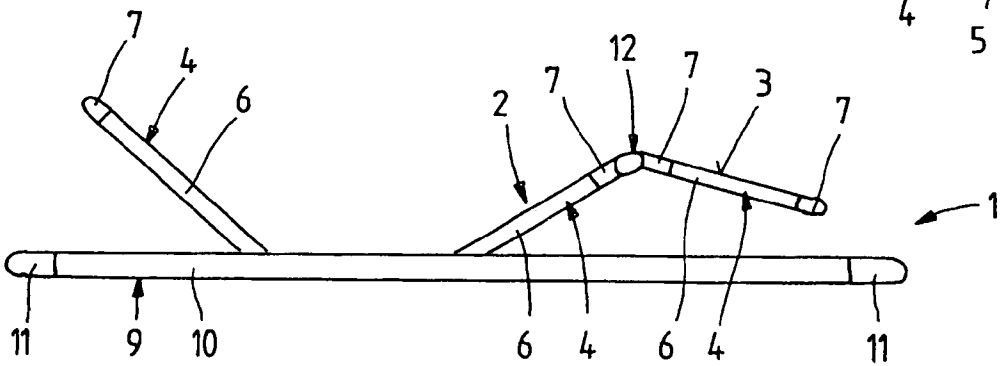
Figure 3:
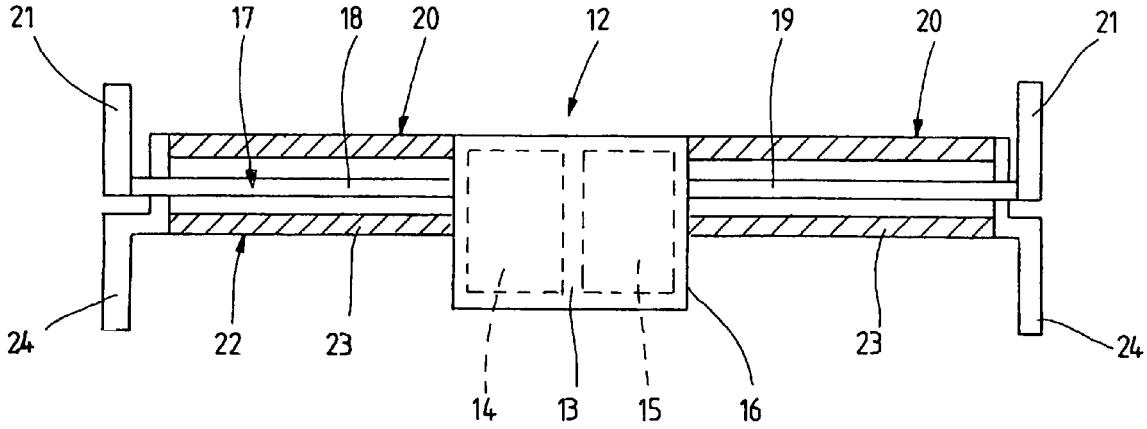
Figure 4:
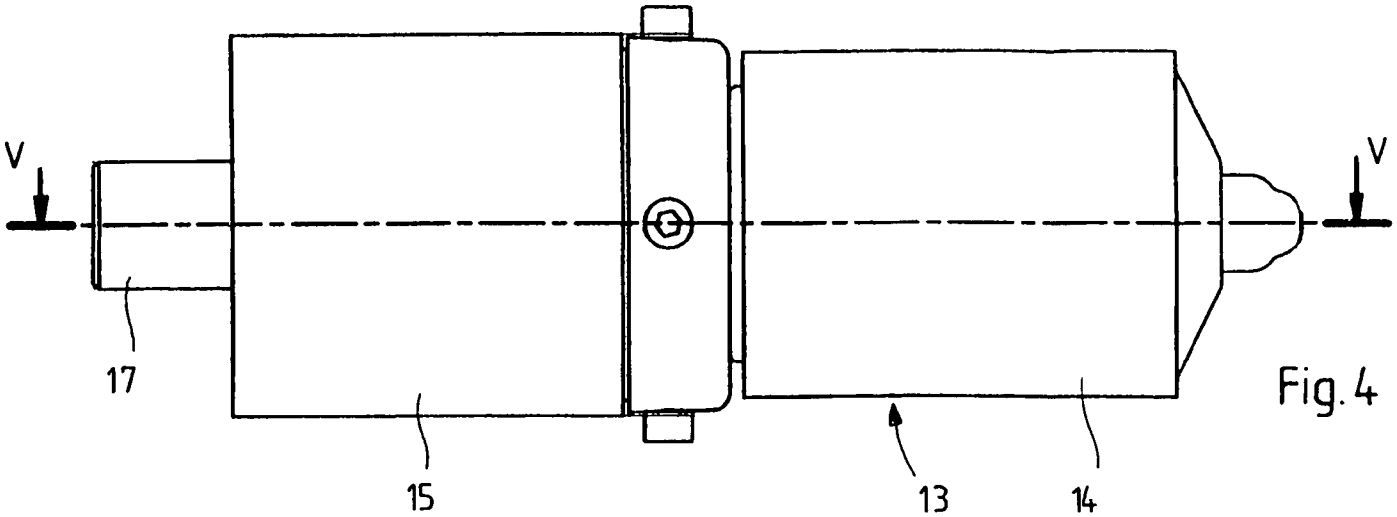
Figure 5:
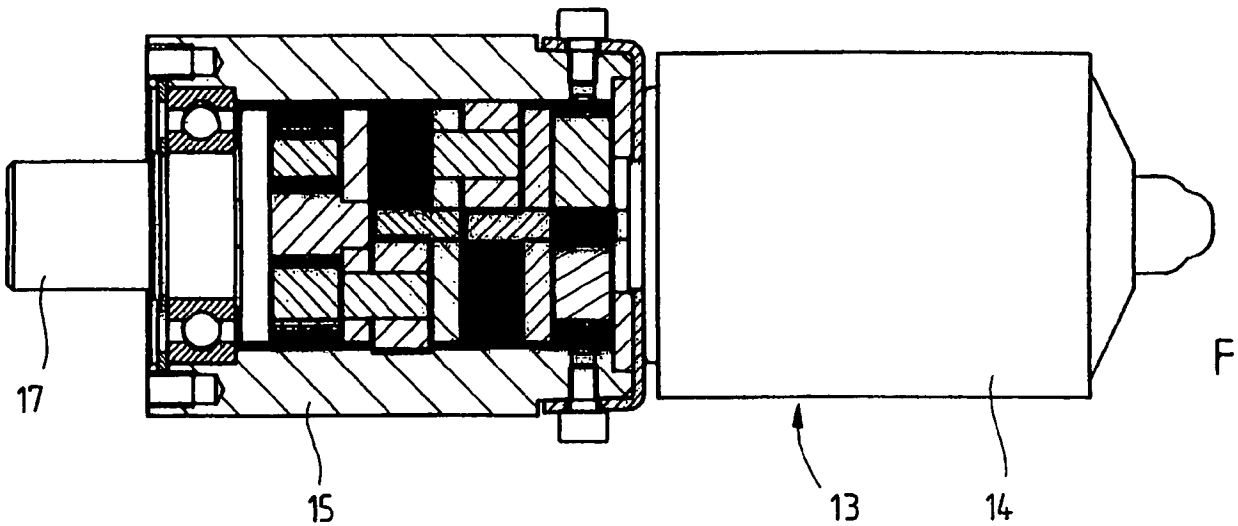
FIG. 5 shows a partial sectional view of the drive device 13 according to FIG. 4, taken along cutting line V-V.
Figure 7:
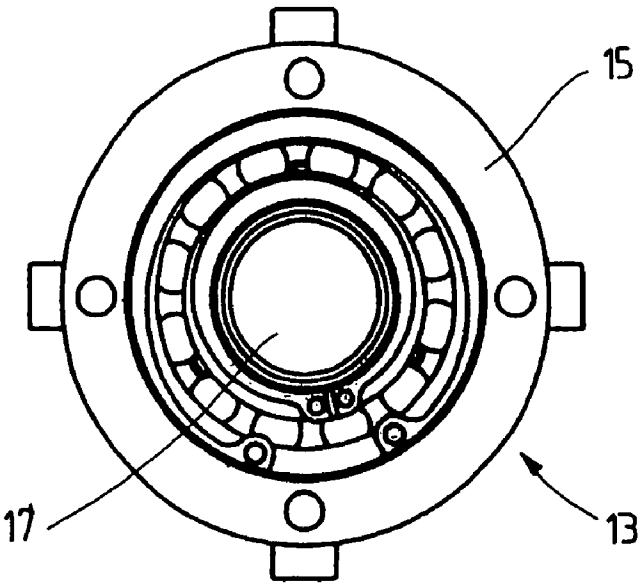
FIG. 7 shows a lateral view of the drive device 13 according to FIG. 4, namely in a viewing direction from the left with respect to the drawing plane of FIG. 4.
Figure 6:
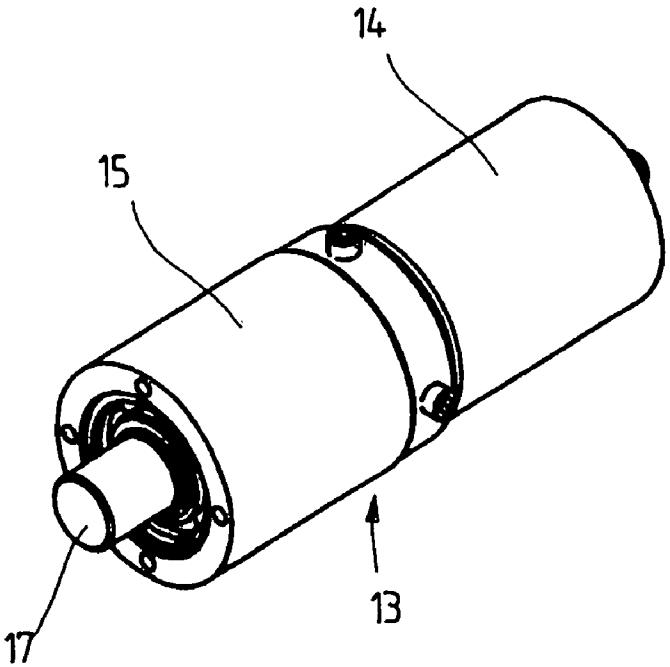
FIG. 6 shows a perspective view of the drive device 13 according to FIG. 4.
Figure 8:
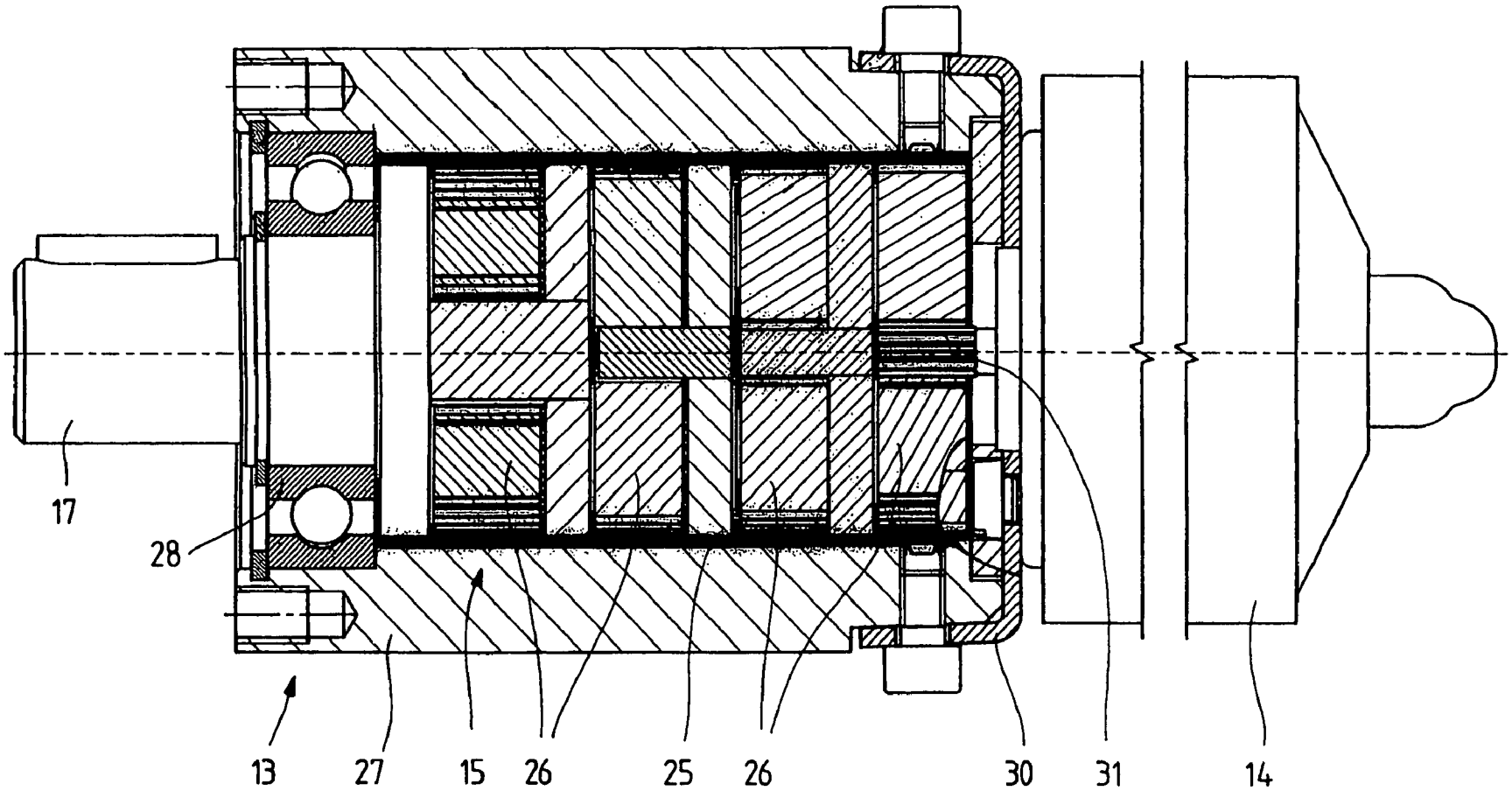
FIG. 8 shows a detailed view of the drive device 13 according to FIG. 5, wherein particularly the structure of the gear transmission 15 is visible.

The gear transmission 15 in a first embodiment according to FIG. 8 is a four-stage gear mechanism. The gear transmission 15 comprises a ring gear 25 on one side and gears 26 meshing with said ring gear on the other side. The gears 26 form the gear stages in a manner which is known per se.

The ring gear 25 and the gears 26 are arranged inside a transmission case 27. On the power output side, a shaft 17 is provided which is in a power-transmitting connection with the gears 26.

The tooth geometry of the gear transmission 15 is such that all gear stages have the identical internal toothing. The ring gear 25 accommodates all the components and serves as a case. The geometry of the first three gear stages is identical.

The gear transmission 15 according to FIG. 8 is a so-called planetary gear transmission, wherein the sun gears and the planetary carriers form one component assembly. For easy manufacturing, the sun gears are pressed into the respective carrier discs. The high torques that must be transmitted do not allow a cylindrical interference fit assembly. For this reason, the sun gear profile in the disc is produced by punching or laser. The shaft is supported by means of an encapsulated roller bearing 28 because of the following advantages: low cost and low space requirement; no axial forces and/or transverse forces; extremely low output speed; and the shaft is additionally supported via the planetary gears.

FIG. 9 shows a perspective view of the gear transmission 15 according to FIG. 8, wherein particularly the individual gears 26 and the planar discs 29 separating the gears from each other can be seen.

The ring gear 25 and an exemplary planar disc 29 are shown in detail in the FIGS. 10, 11, 12 and 13.

Figure 15:
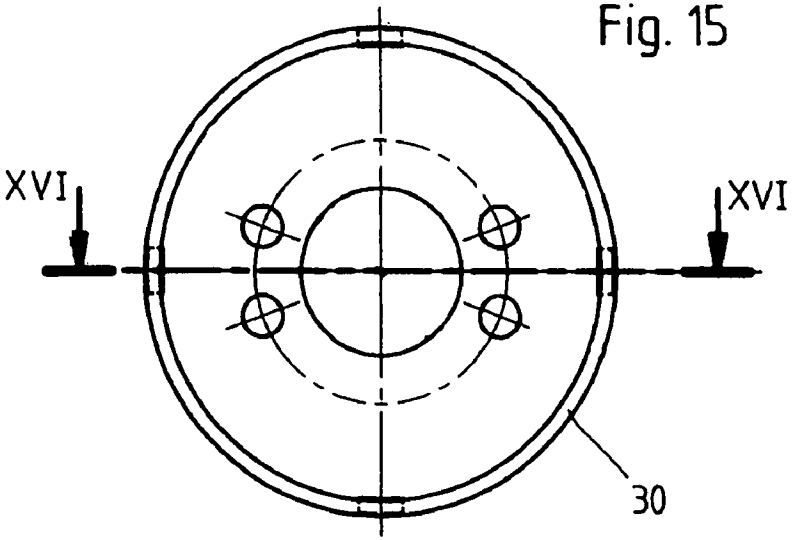
Figure 16:
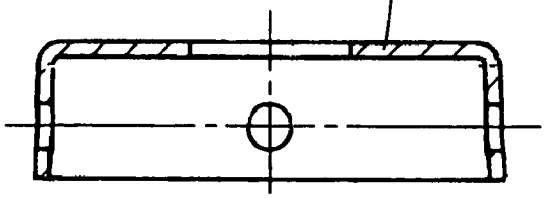
Figure 13:
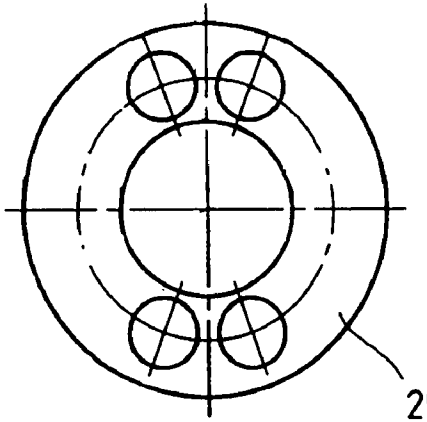
Figure 14:
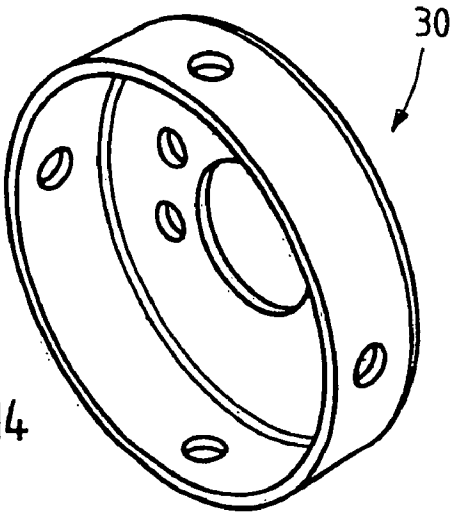

FIG. 8 further shows that the gear transmission 15 is closed on the motor side by means of cap 30. The cap 30 is shown in detail in the FIGS. 14, 15 and 16.

Figure 17:
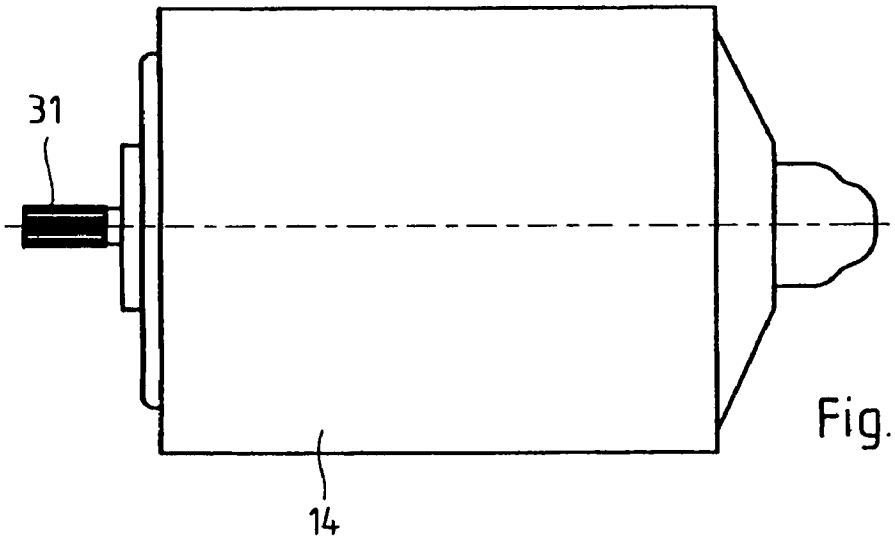

FIG. 17 shows the motor 14 which is flanged to the gear transmission 15 according to FIG. 8, and in particular the design of the motor-side pinion 31.

Figure 18:
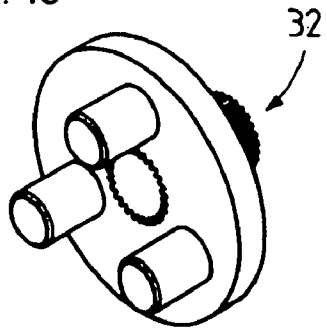
Figure 20:
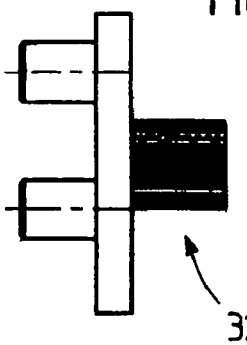
Figure 19:
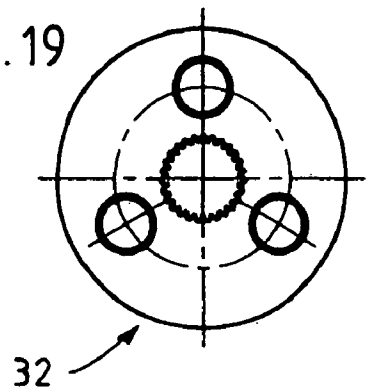

The FIGS. 18, 19 and 20 each show in a different view a planetary carrier 32, wherein the FIGS. 18 to 20 show the planetary carrier 32 of the final stage of the gear transmission 15 according to FIG. 8.

Figure 21:
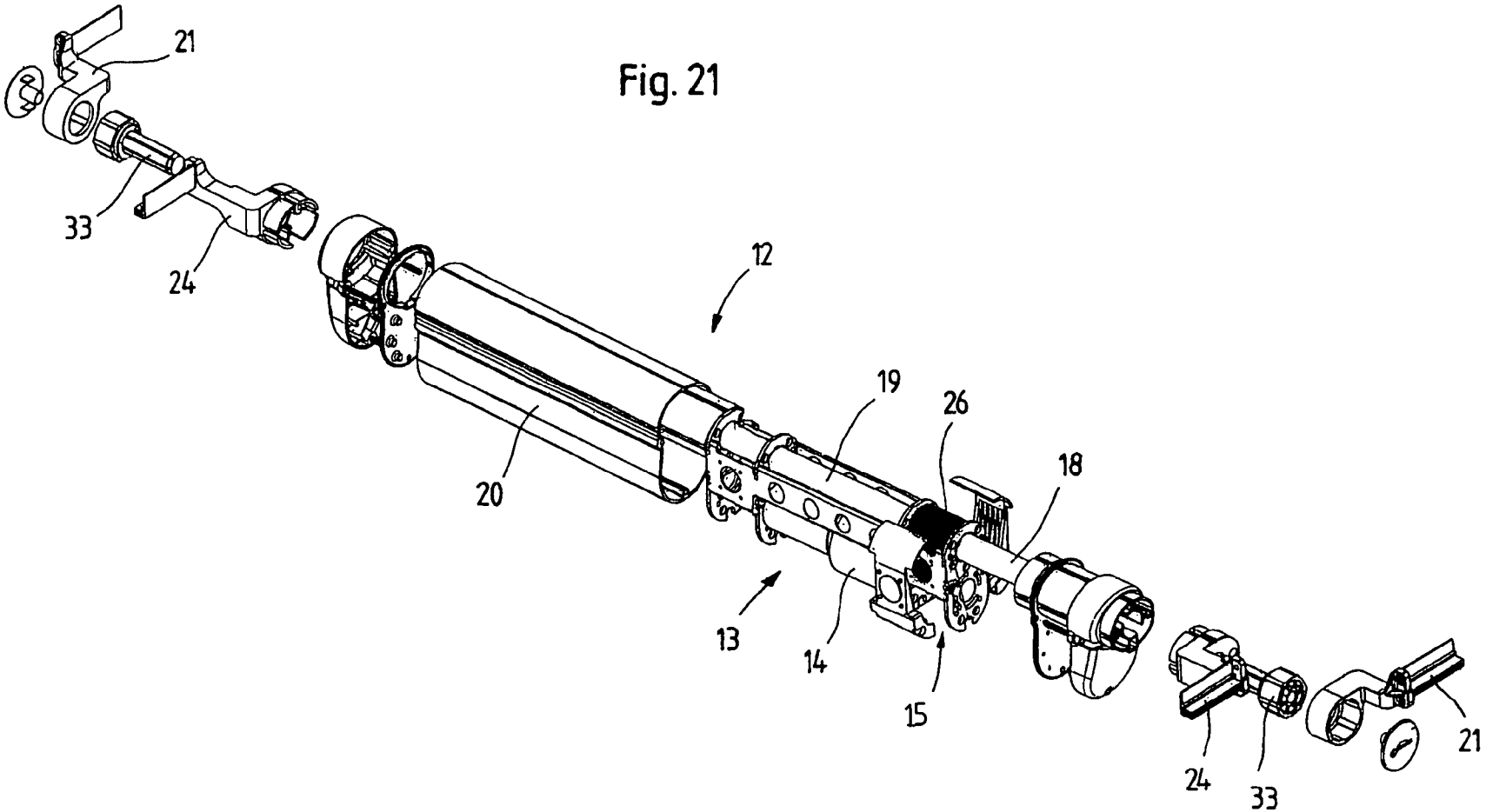
Figure 22:
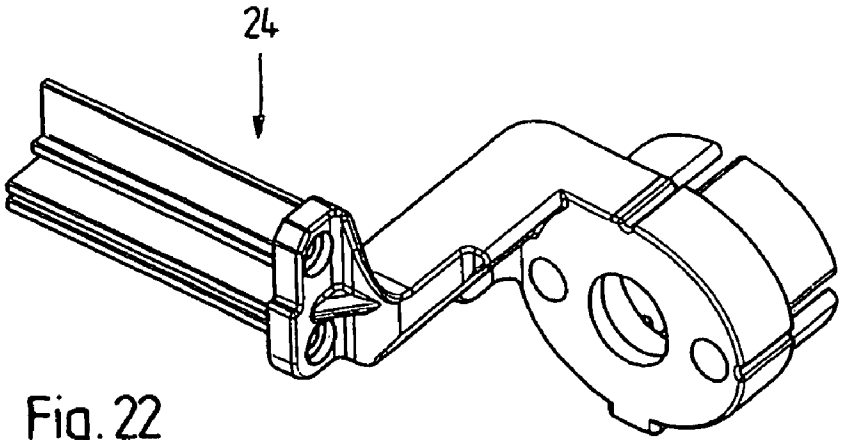
Figure 23:
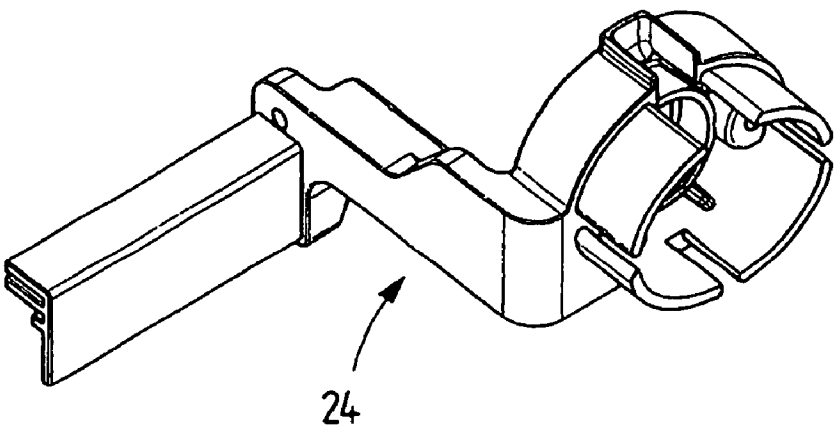
Figure 25:
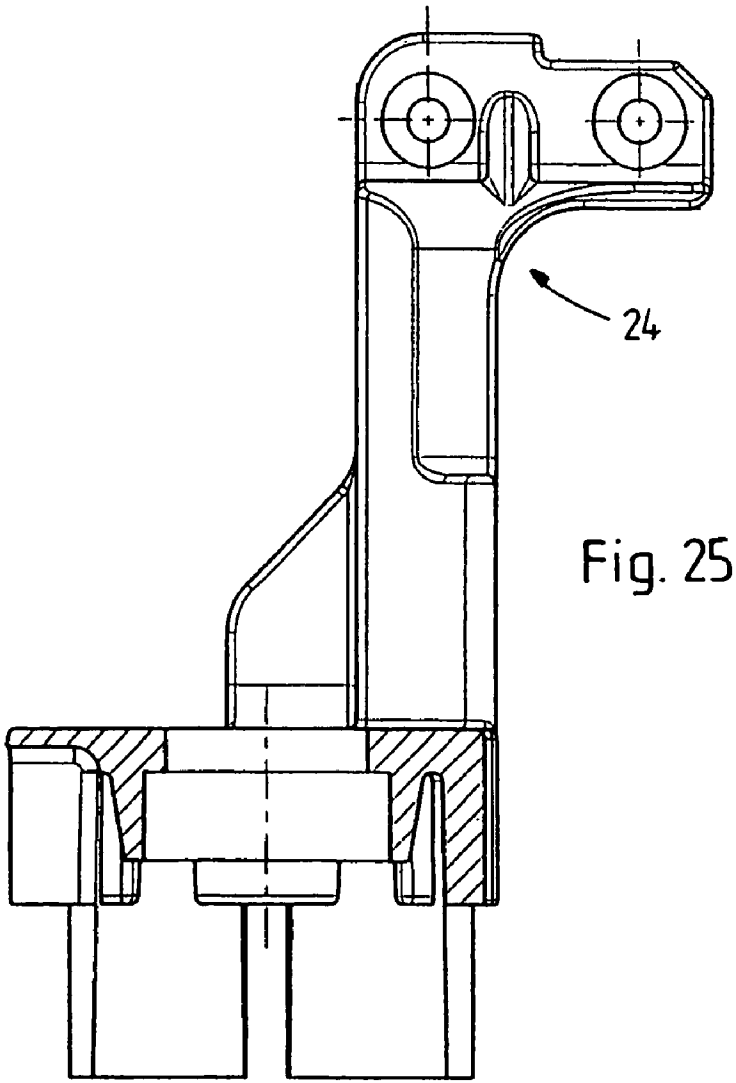
Figure 24:
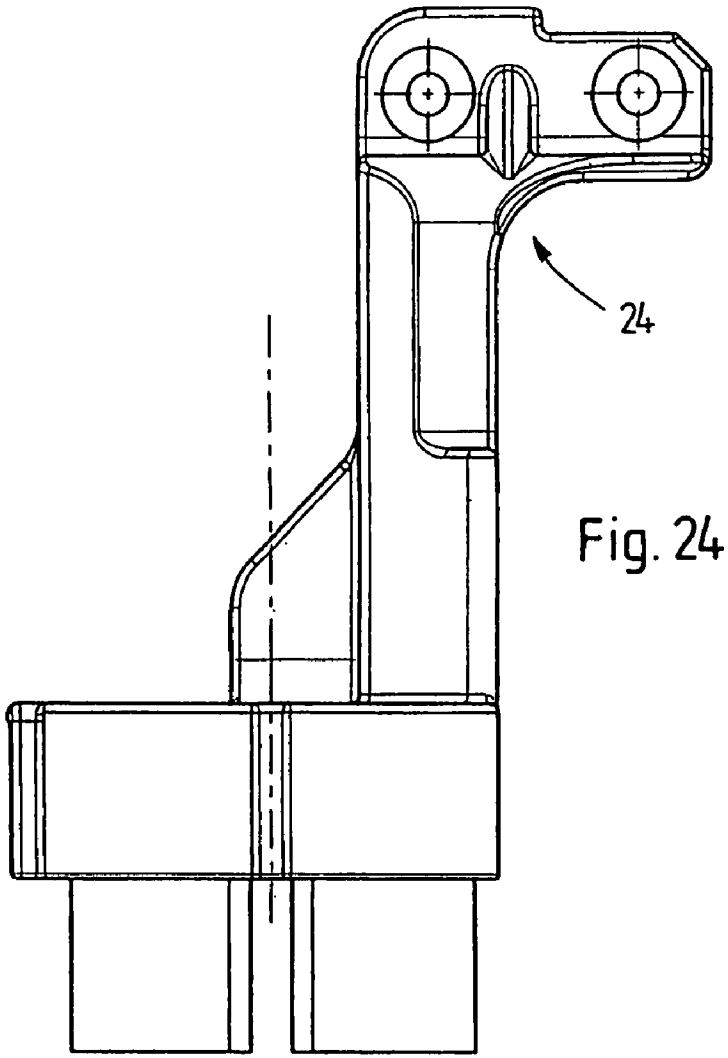

FIG. 21 shows an exploded view of a second embodiment of the invention which differently from the embodiment shown in the FIGS. 4 to 20 is characterized in that a toothed belt is employed as a means for transmitting the motor power. The toothed belt itself is not illustrated in FIG. 21, but the associated gears 26 can be seen.

Figure 28:
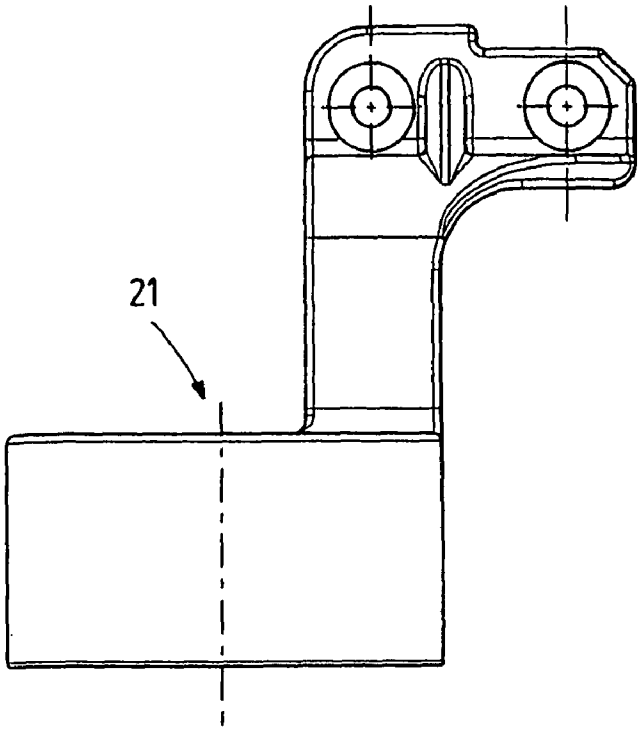
Figure 26:
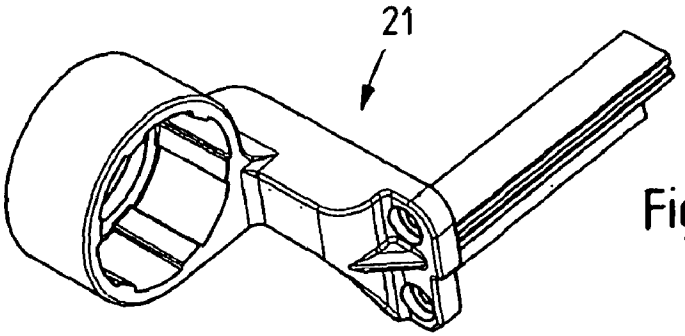
Figure 27:
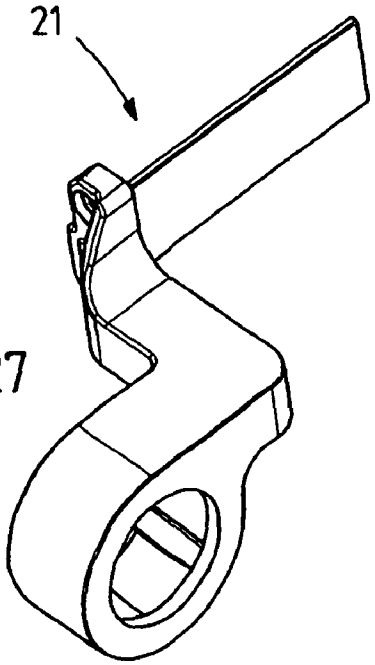

FIG. 21 clearly shows the neck flanges 24 or the fixing flanges 21, respectively. The right neck flange 24 with respect to the drawing plane according to FIG. 21 is shown in a detailed view in the FIGS. 22, 23, 24 and 25. The left fixing flange 21 with respect to the drawing plane according to FIG. 21 is shown in a detailed view in the FIGS. 26, 27 and 28.

Figure 30:
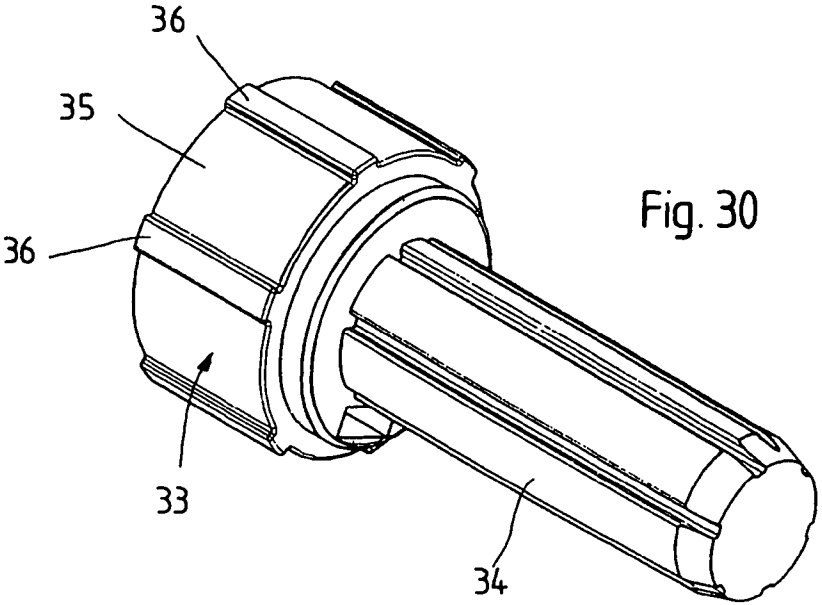
Figure 29:
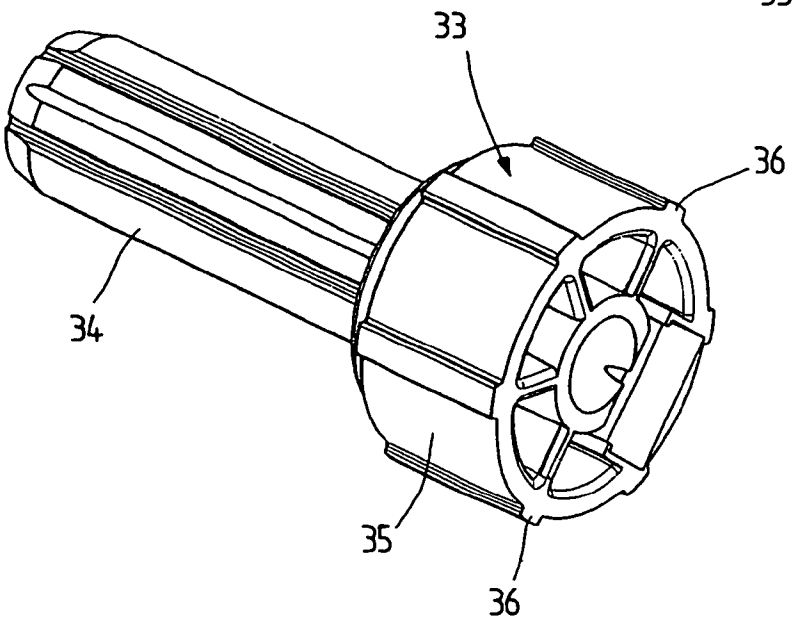
Figure 33:
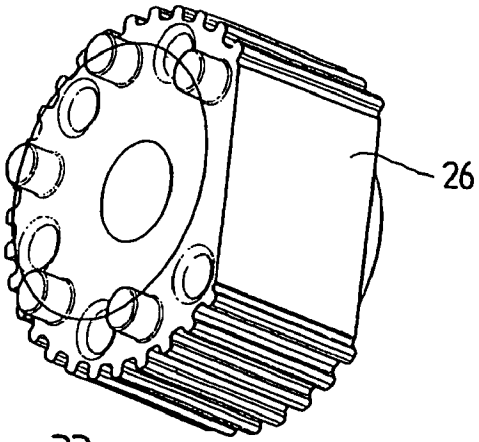
Figure 34:
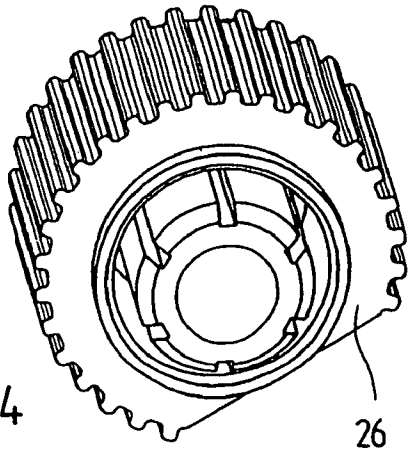
Figure 31:
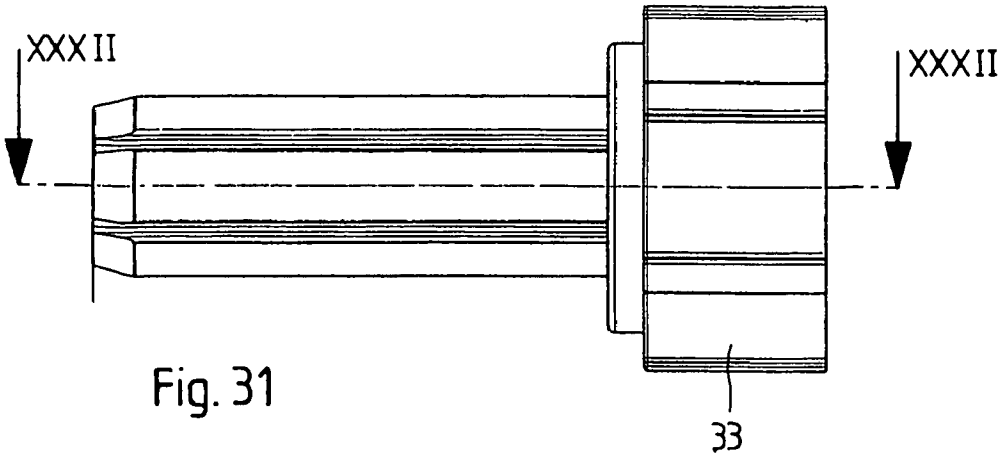
Figure 32:
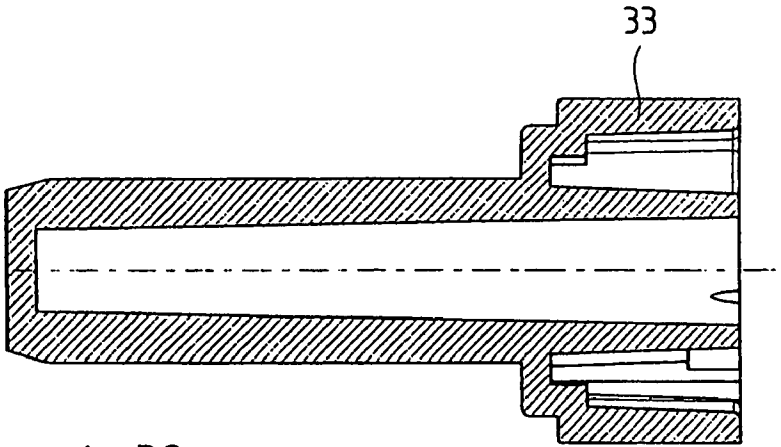
Figure 36:
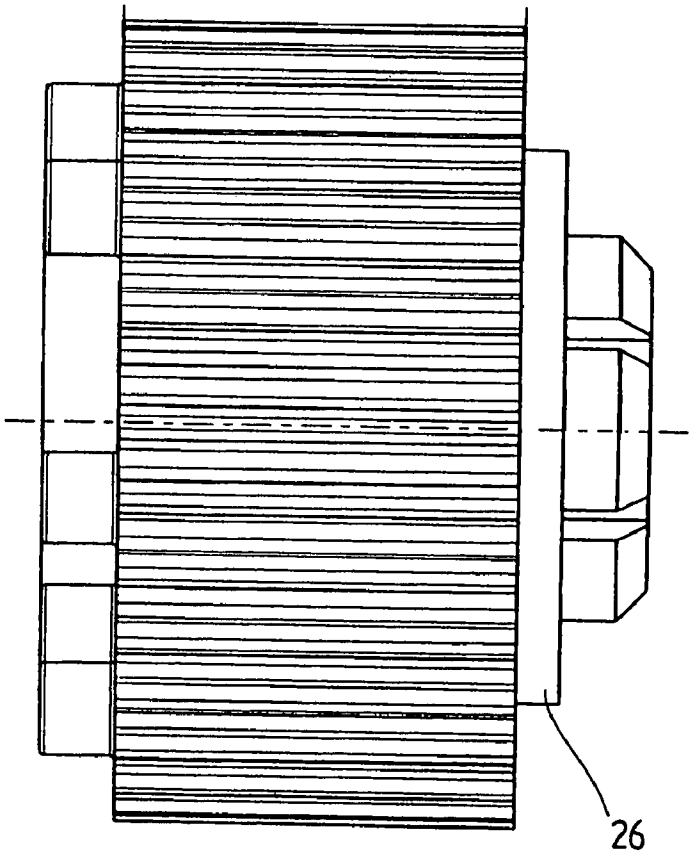
Figure 35:
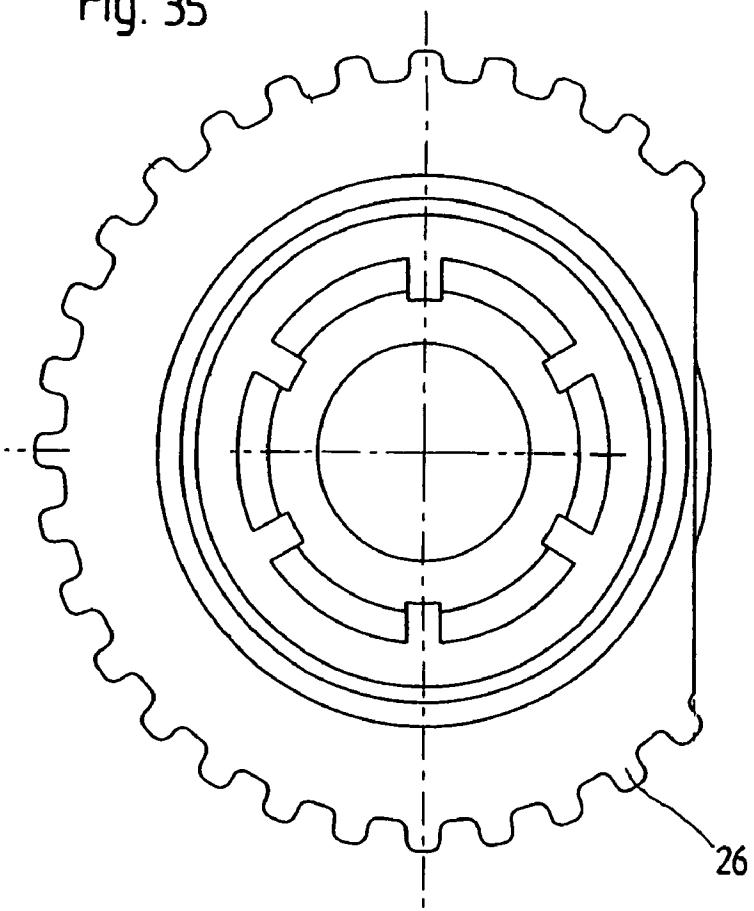
Figure 37:
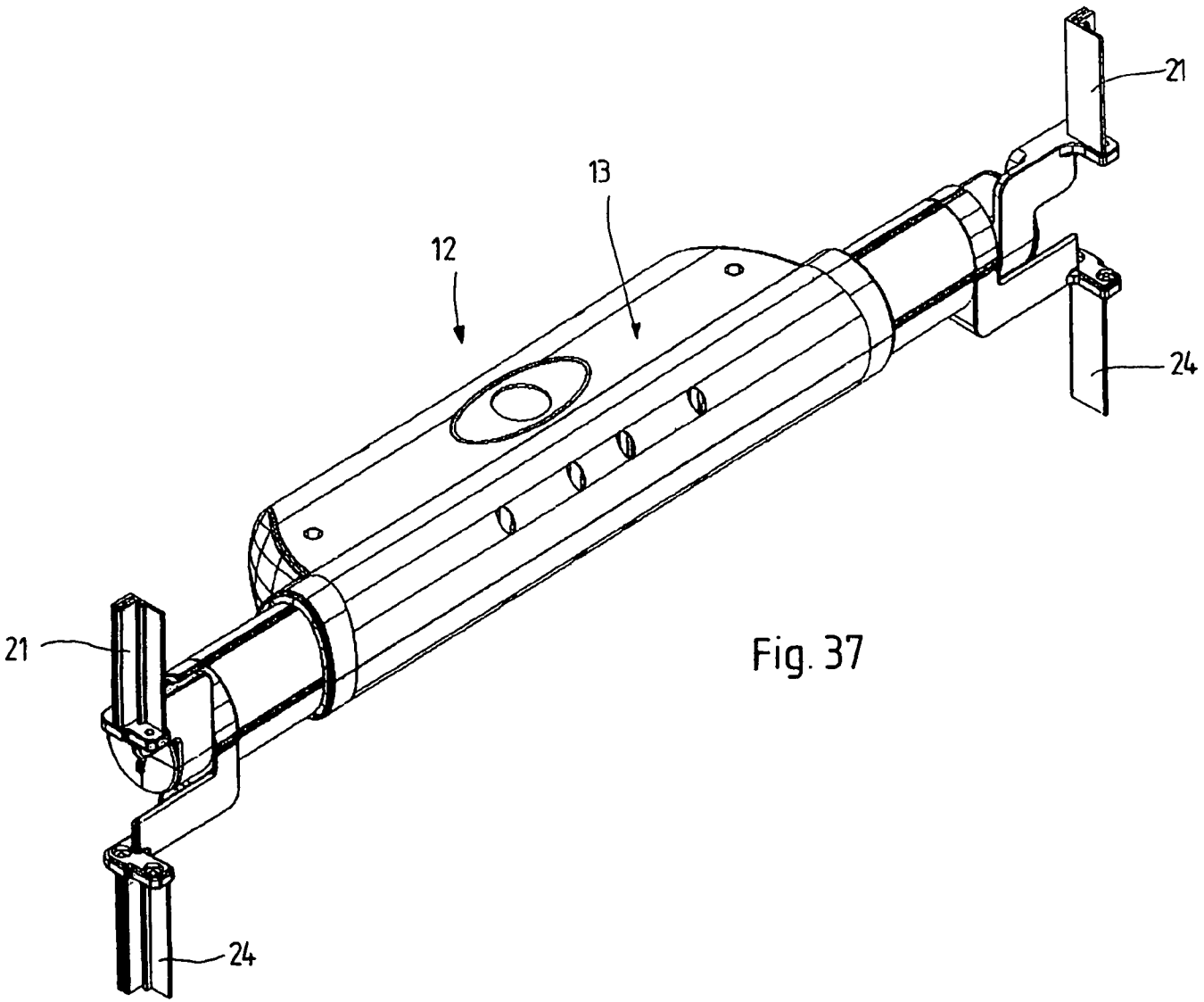
Figure 38:
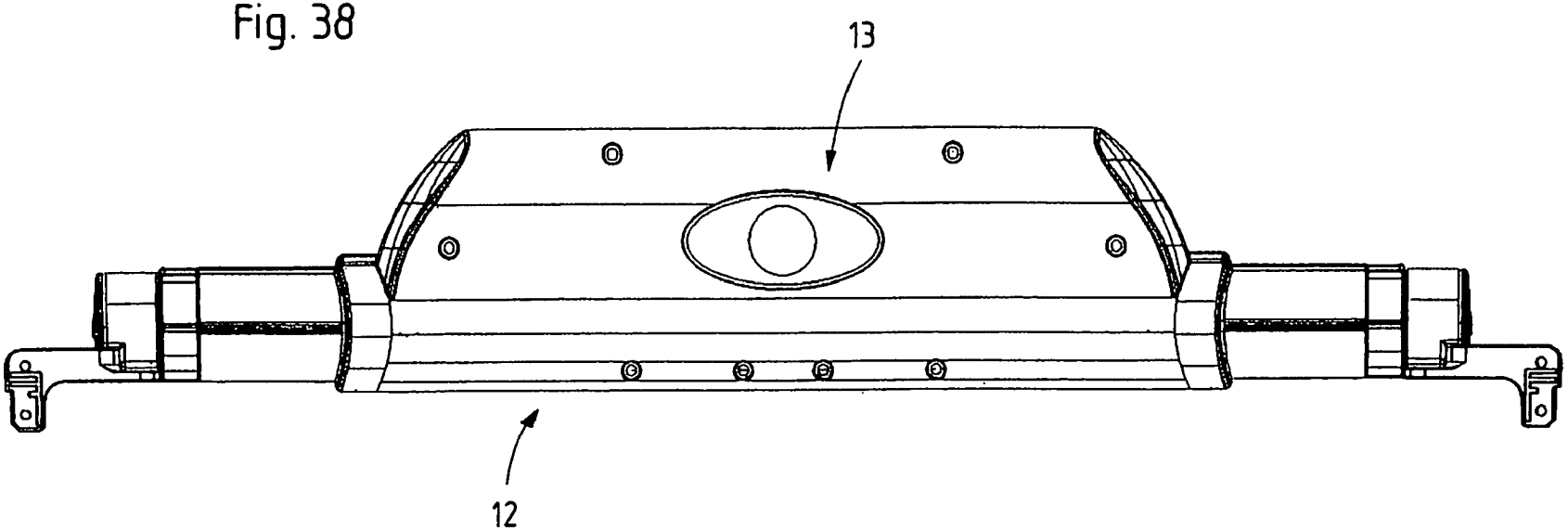
Figure 39:
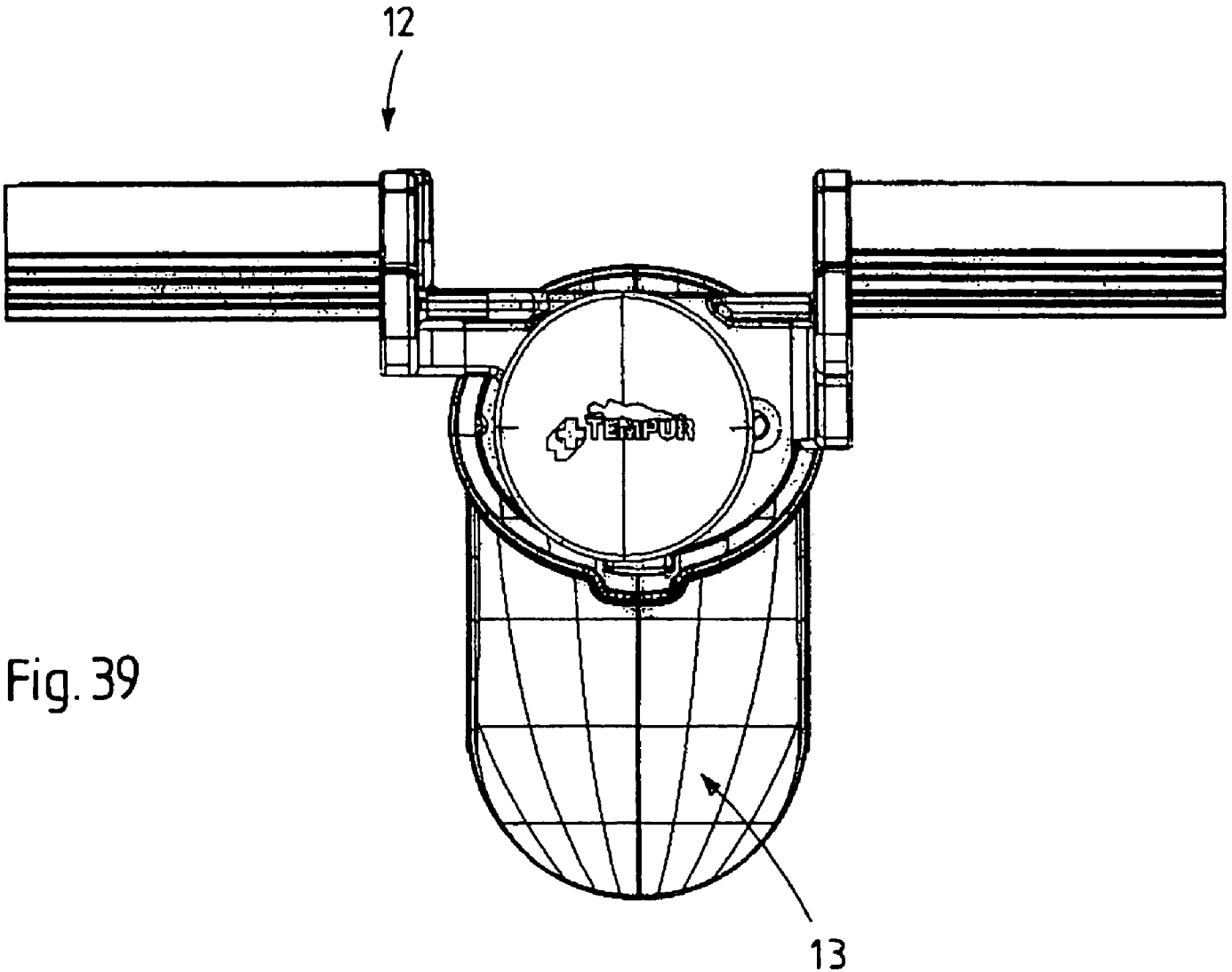
Figure 40:
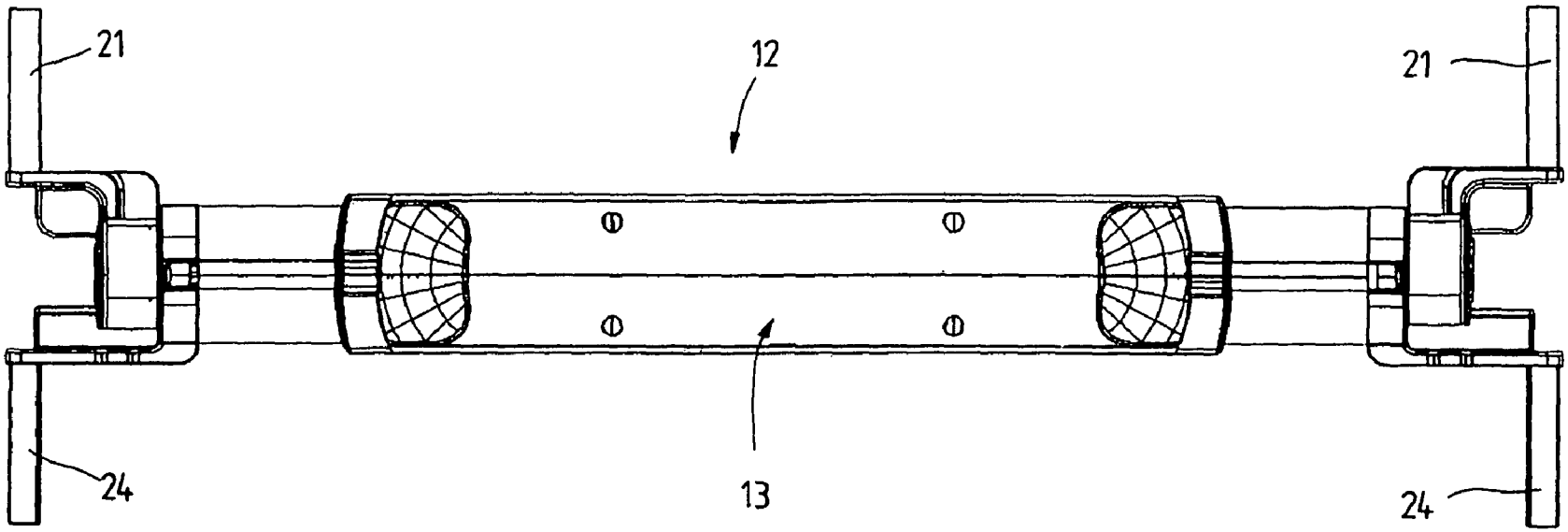
Figure 41:
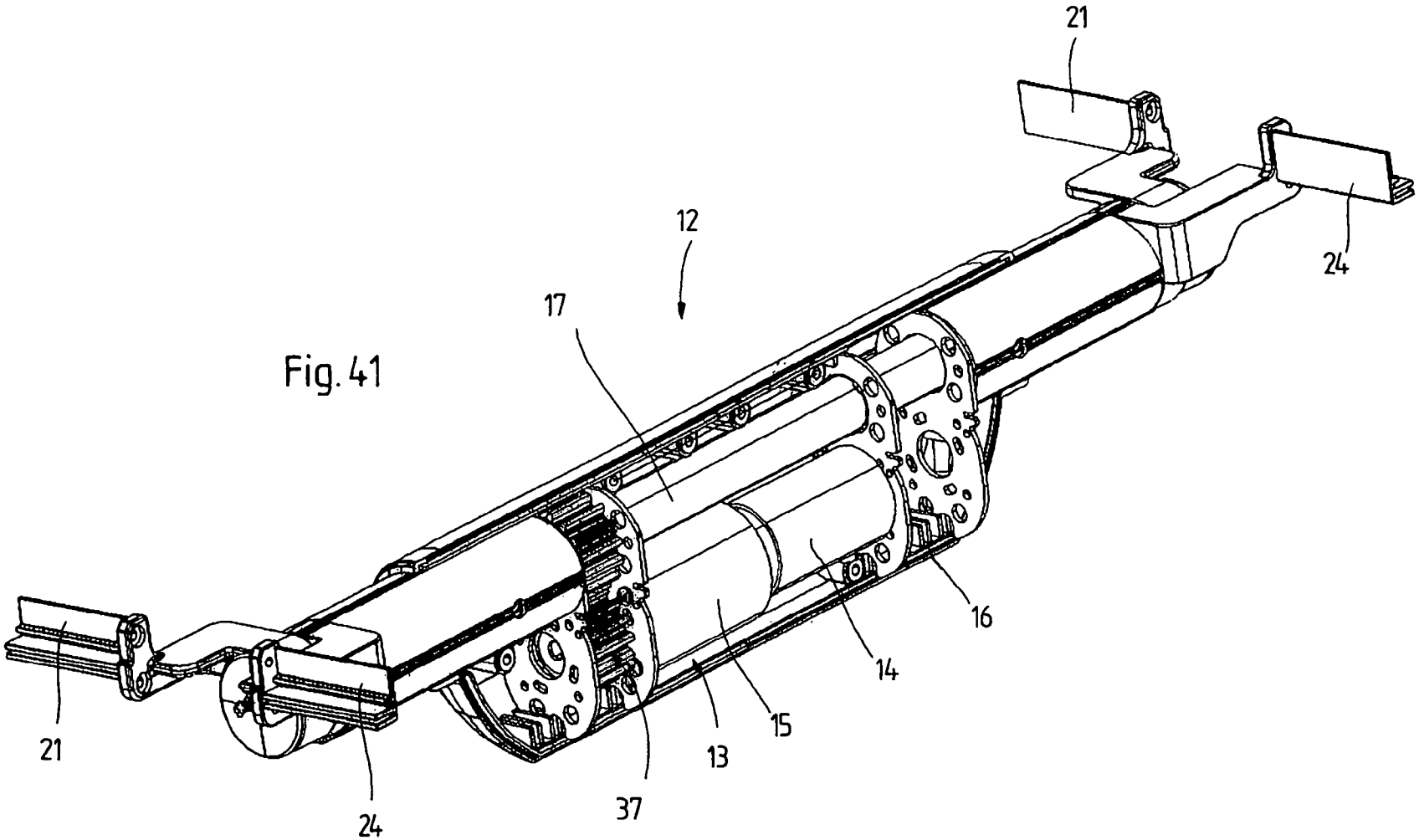
Figure 42:
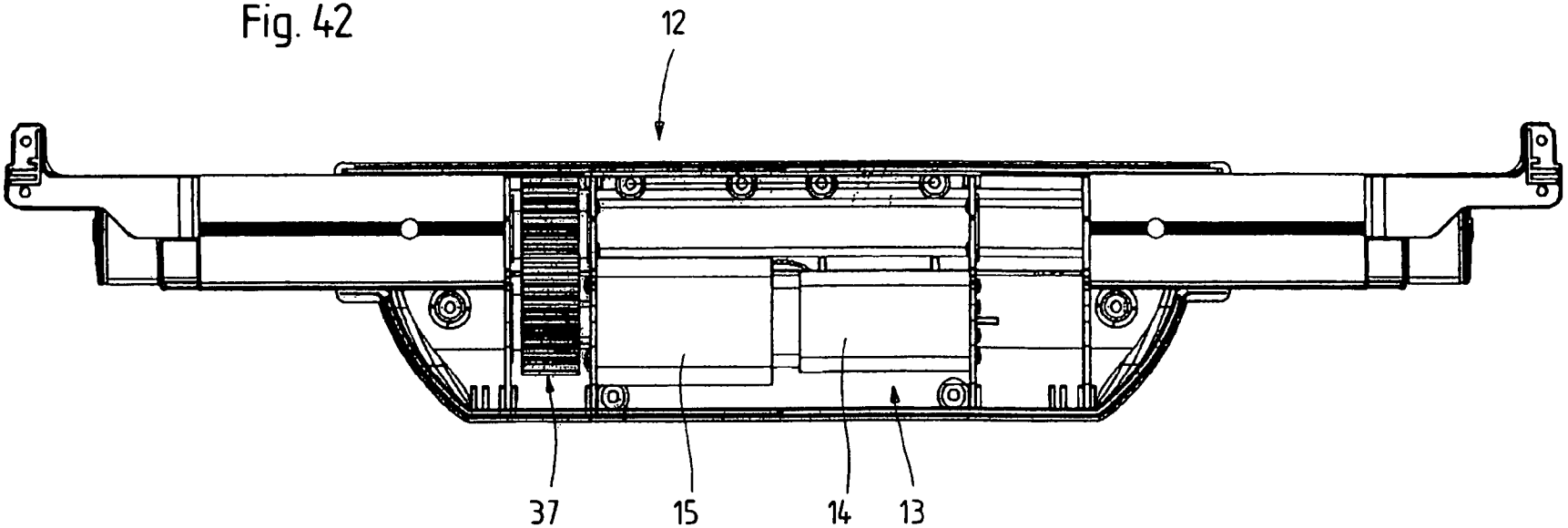
Figure 43:
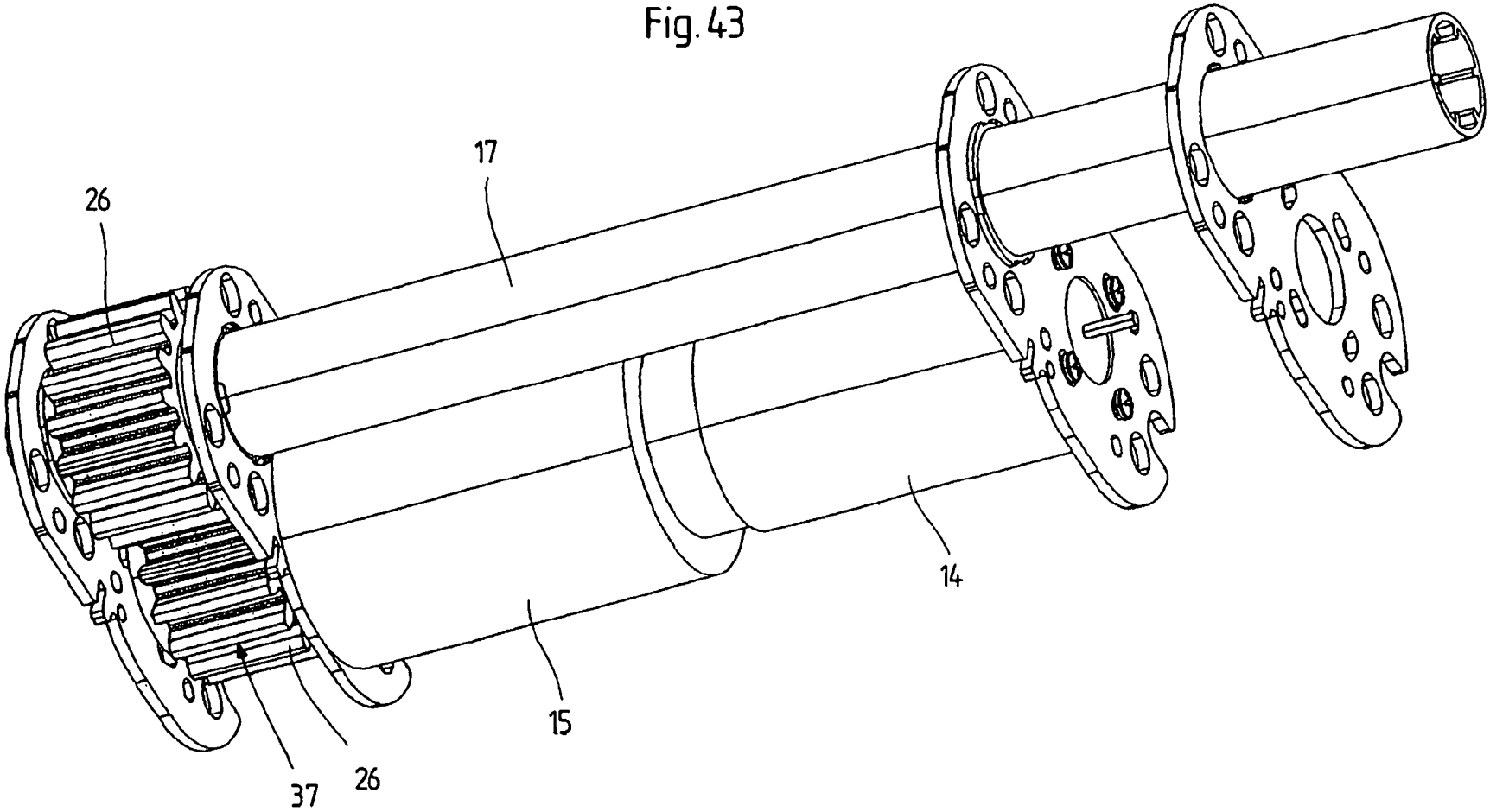

For coupling the fixing flanges 21 to the respectively associated semi-shafts 18 or 19 of the shaft, a connecting part 33 is used in the embodiment according to FIG. 21. This connecting part 33 is shown in detail in the FIGS. 29, 30, 31 and 32. As can be seen especially from the FIGS. 29 and 30, the connecting part 33 consists of a pin-like appendix 34 and a head 35. The head 35 carries on the periphery thereof ribs 36 which run in the longitudinal direction and in the mounted state engage with corresponding teeth of the respectively associated fixing flanges 21, as shown particularly by FIG. 21. A tooth belt gear 26, as it may be used for example in the embodiment according to FIG. 21, is shown in the FIGS. 33, 34, 35 and 36.

A third embodiment of the pivoting device 12 according to the invention is shown by the FIGS. 37 to 43.

Particularly the illustration according to FIG. 21 shows a motor 14 and a gear transmission 15 arranged inside a housing 16, the power being redirected to the shaft 17 by means of a gear arrangement 37. This gear arrangement 37 is shown again in more detail in the FIG. 43. It can be seen from FIG. 43 that the gear arrangement 37 is comprised of two frontally meshing gears 26.

Figure 44:
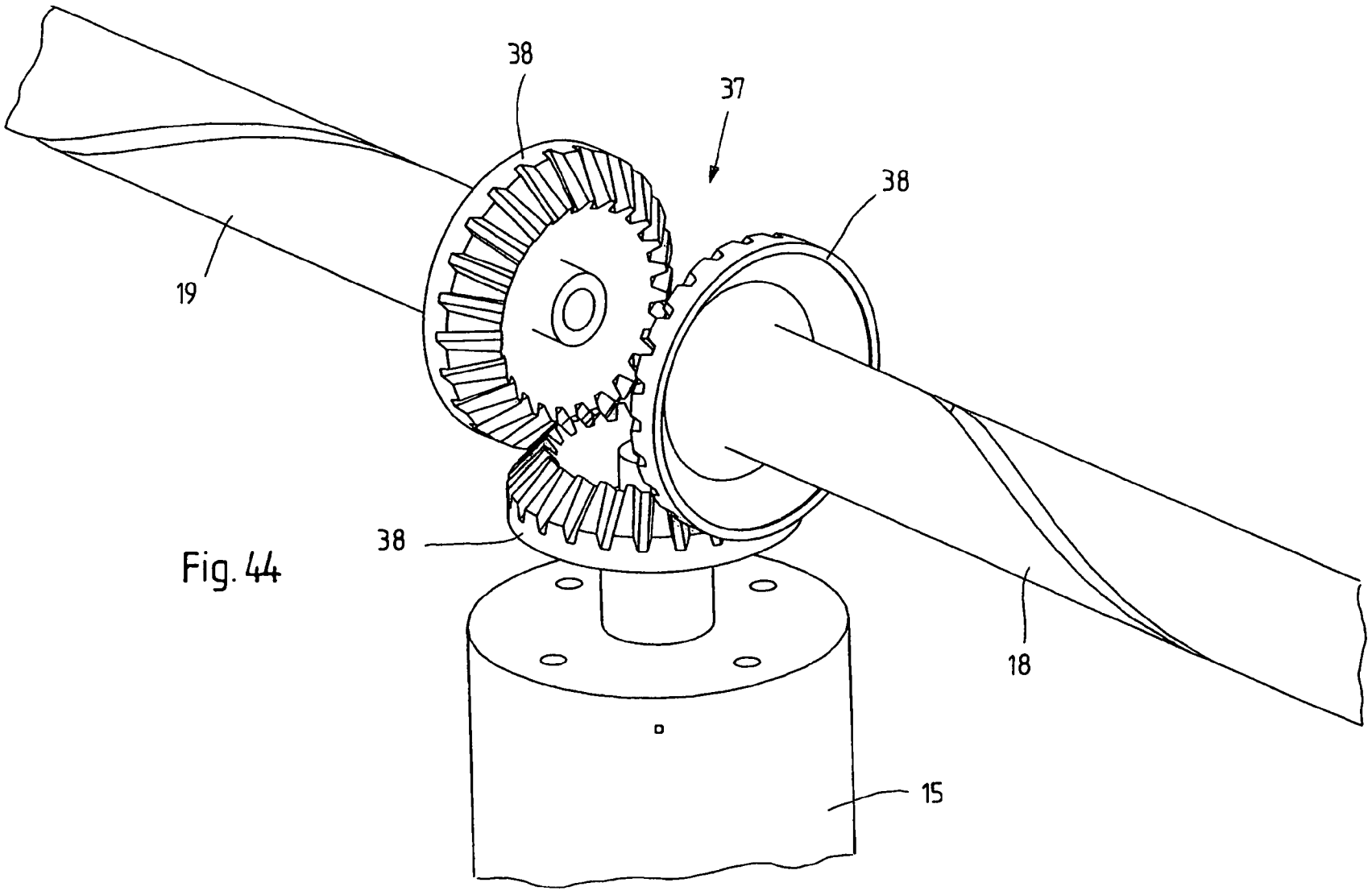

A different design of the gear arrangement 37 is shown by FIG. 44 illustrating a fourth embodiment of the invention. According to this embodiment, three bevel gears cooperate with each other, and each semi-shaft 18 or 19 carries a bevel gear 38 on its end. These two bevel gears engage with a bevel gear 38 that is flanged to the gear transmission 15.

Figure 45:
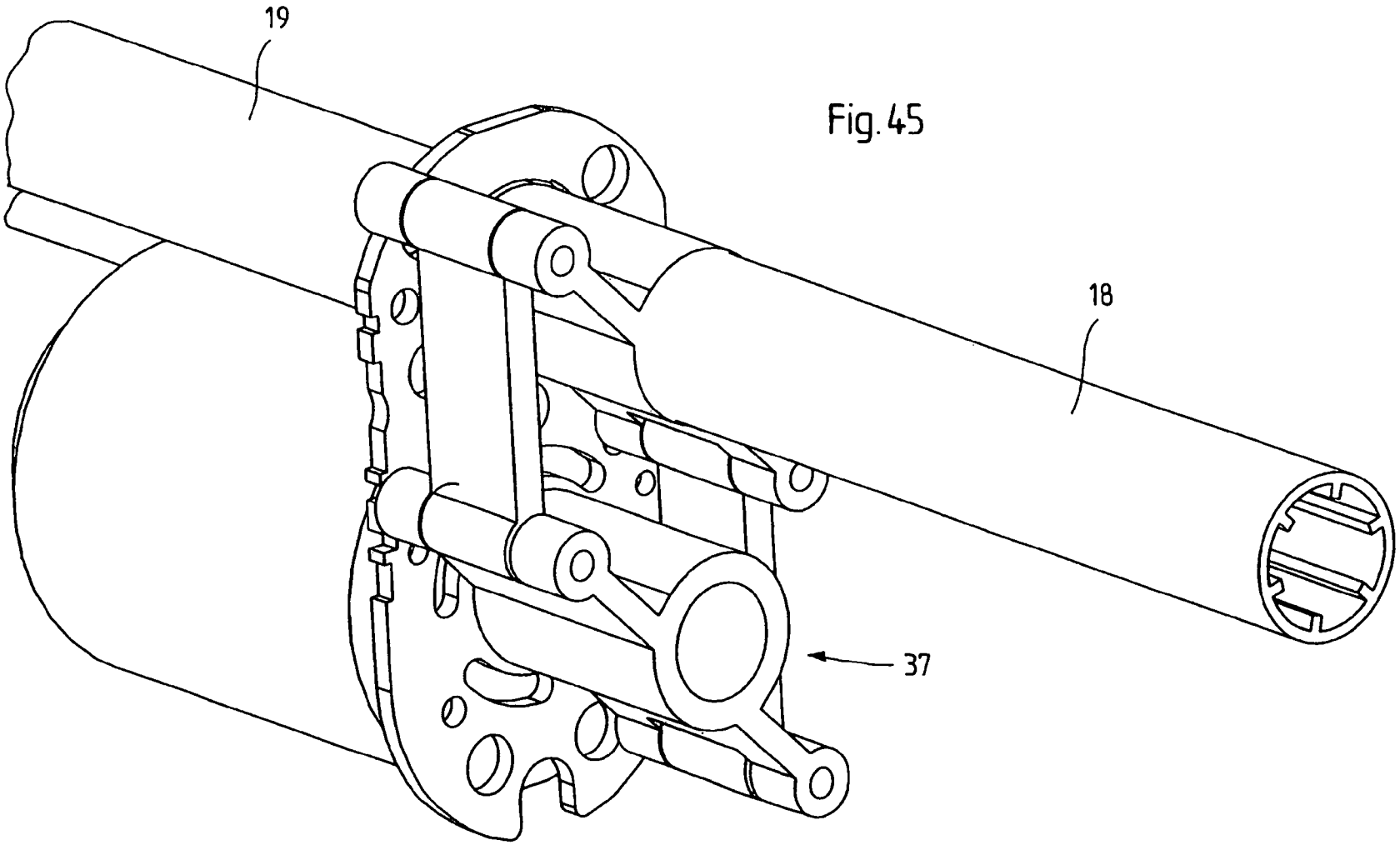
Figure 46:
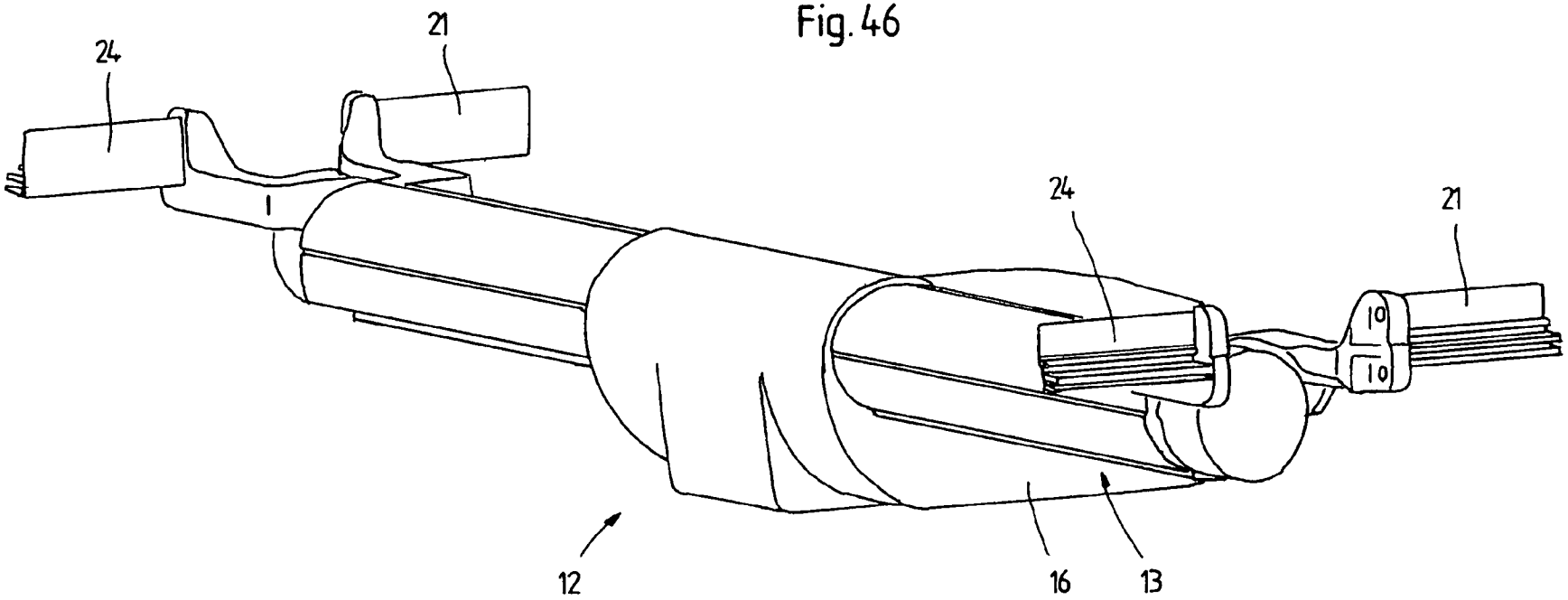
Figure 47:
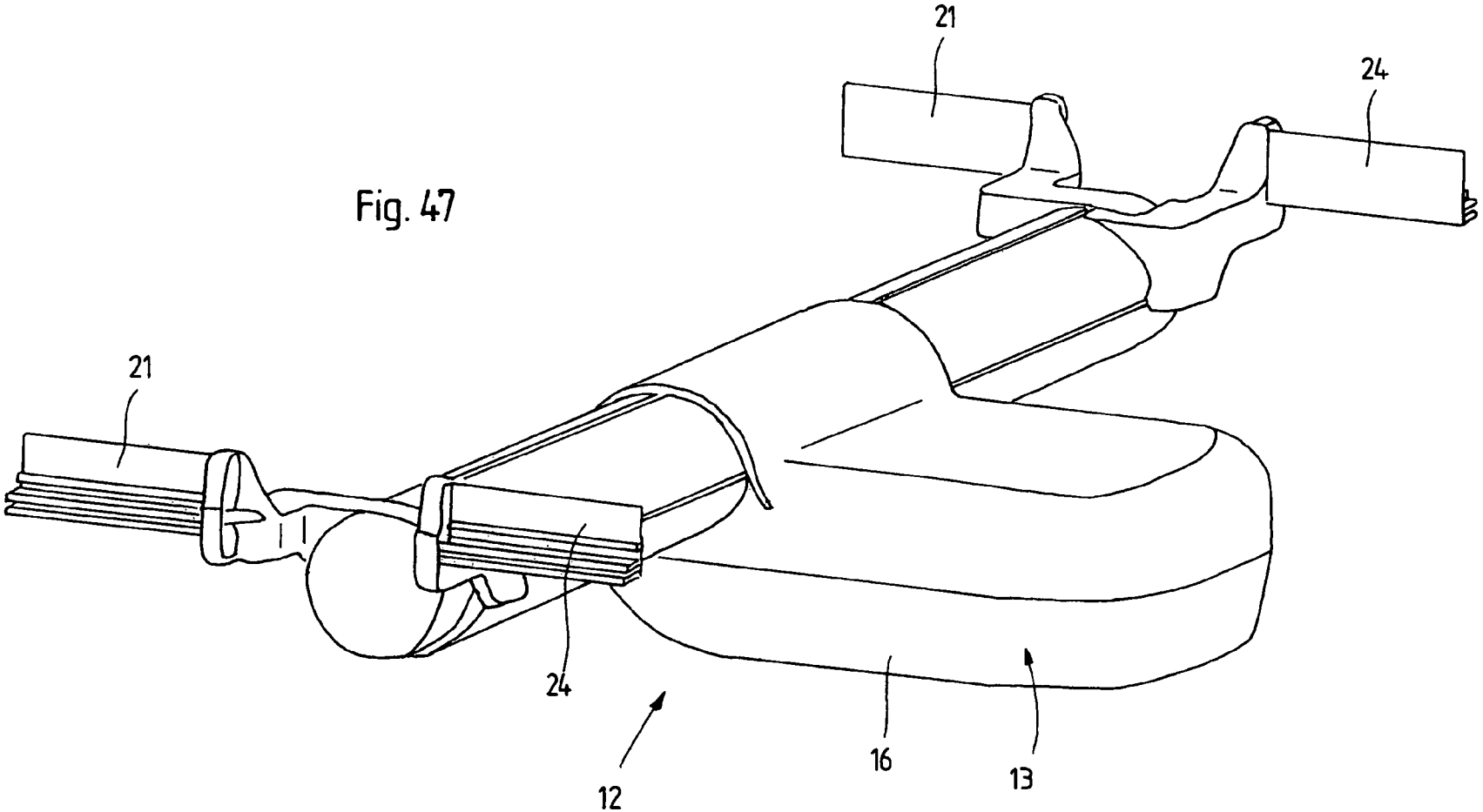
Figure 48:
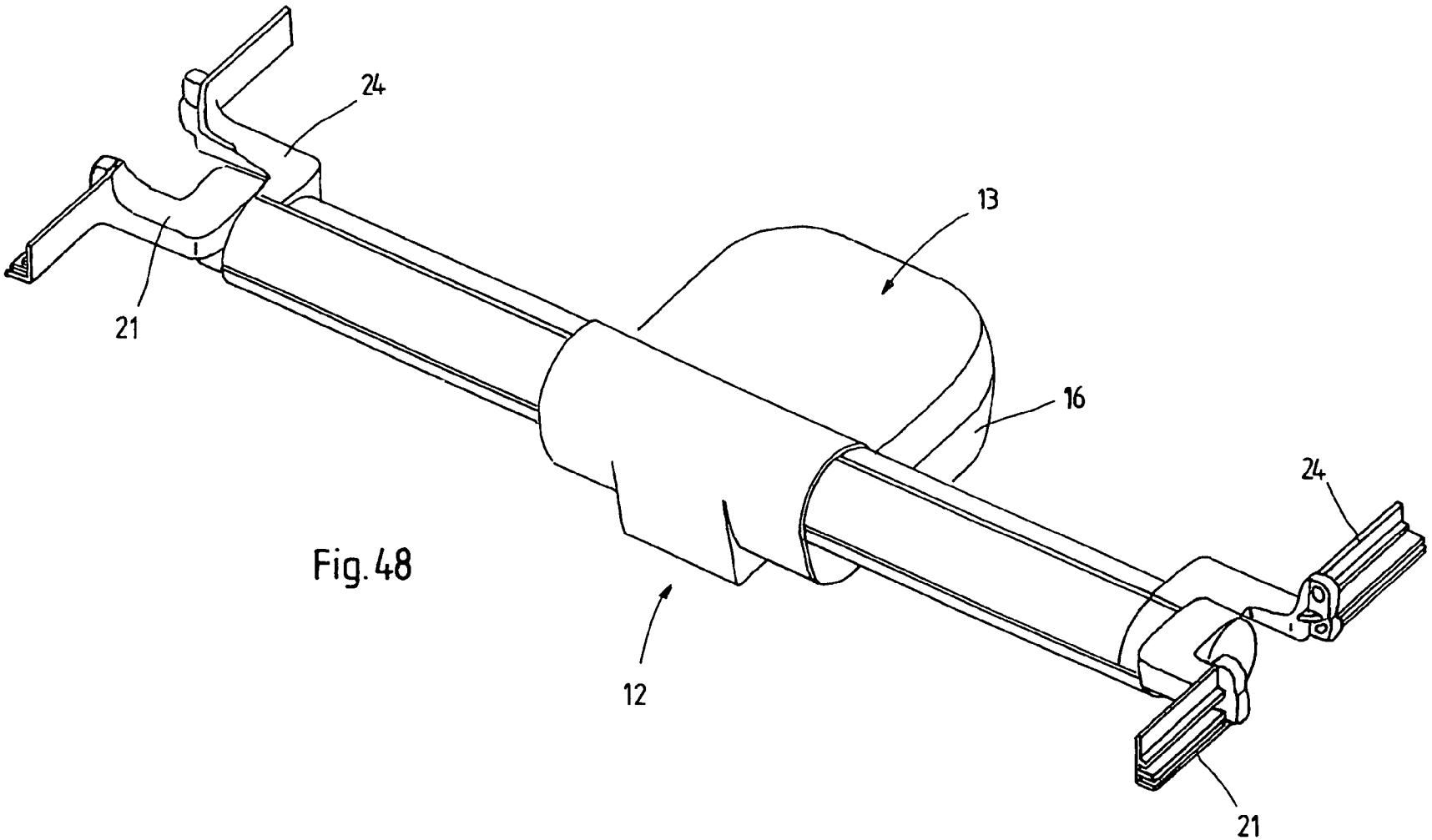
Figure 49:
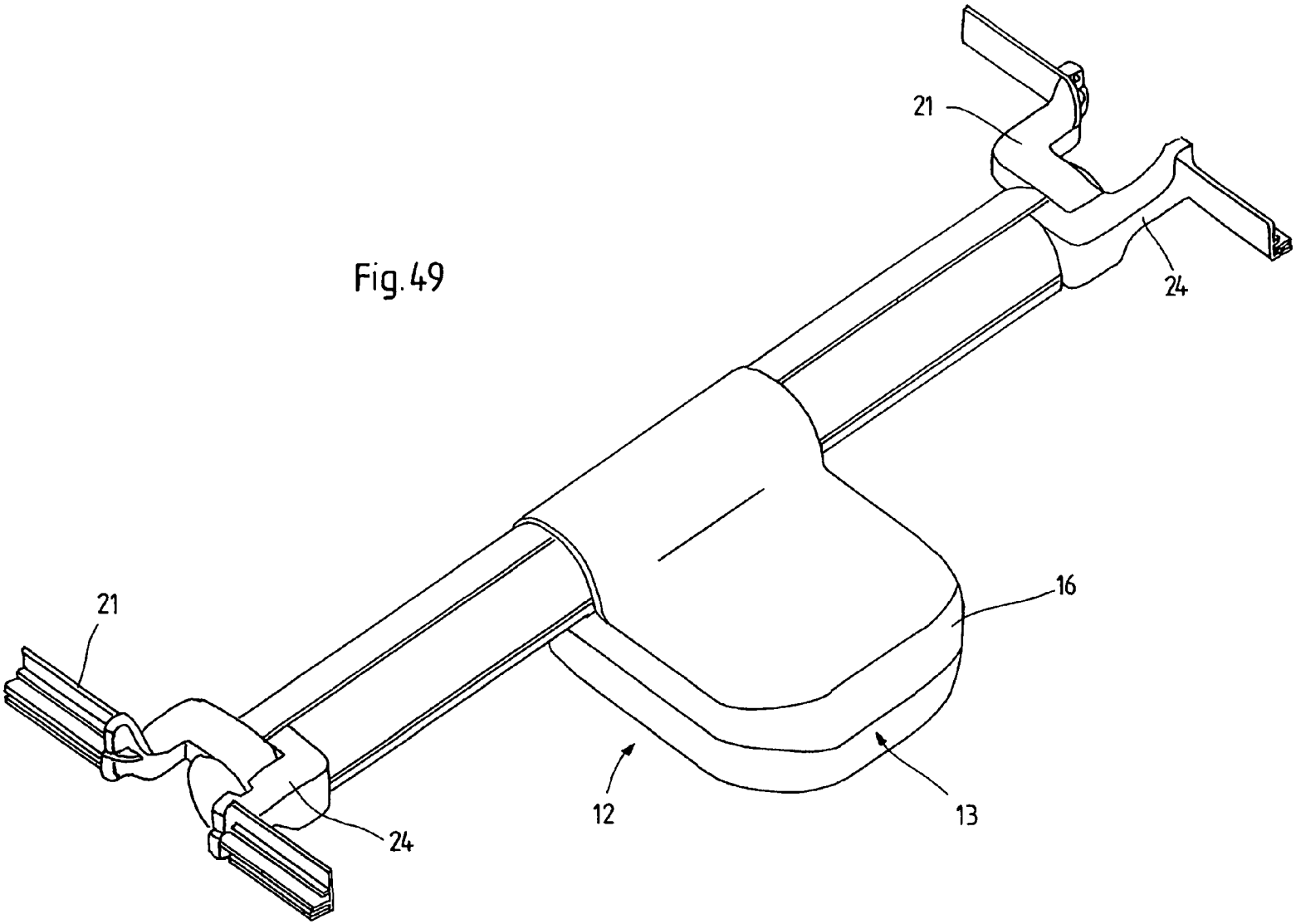

FIG. 45 illustrates a further design of a gear arrangement 37 according to a fifth embodiment of the invention. According to this embodiment, a tetrahedron sprocket chain in the form of a parallelogram is employed for the transmission of power.

Figure 50:
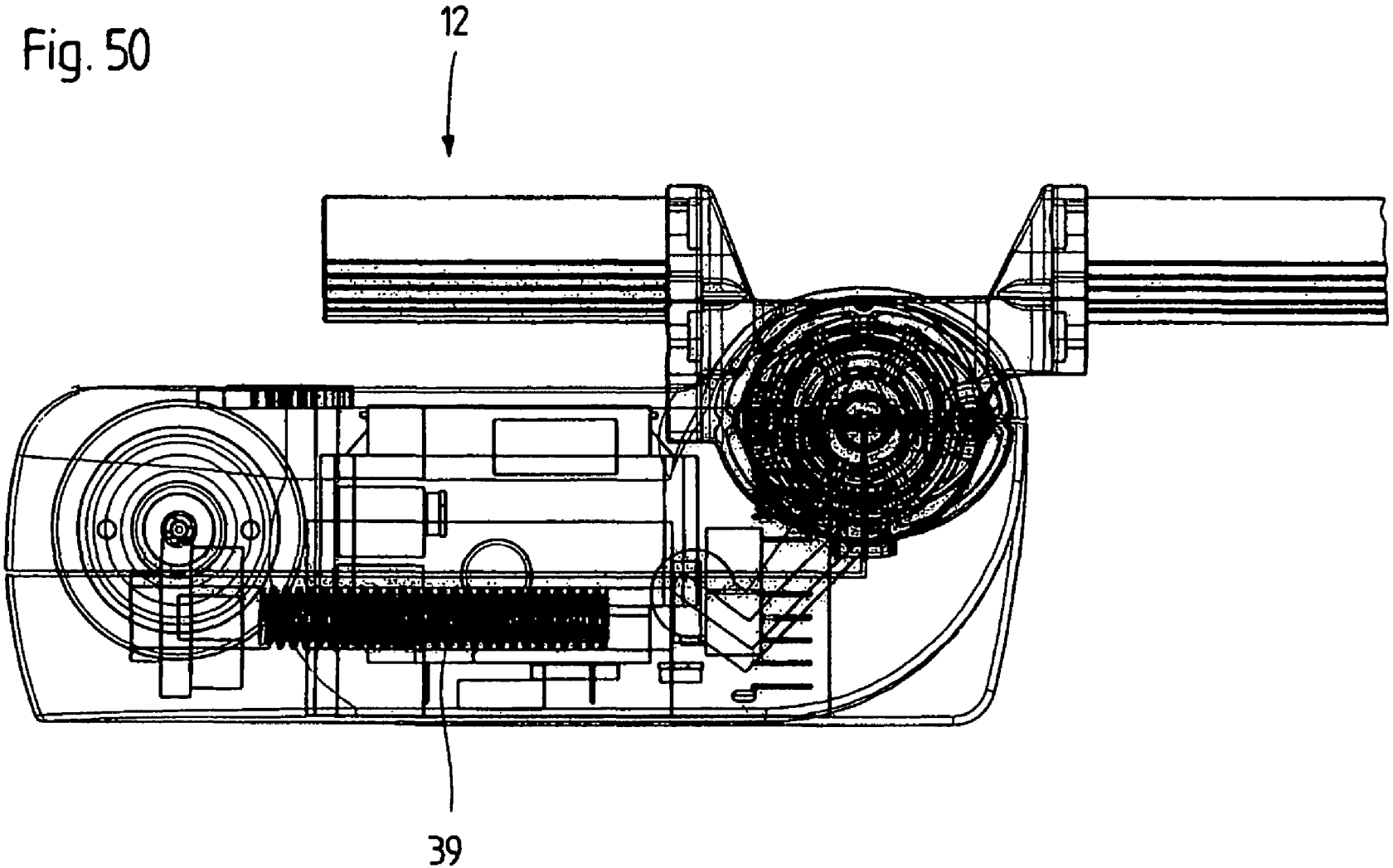

A sixth embodiment of the invention is shown by the FIGS. 46 to 50. The distinctive feature of this design results particularly from the compact structure of the drive device 13 which is accommodated inside the housing 16, as it can be seen especially in FIG. 50. The particular advantage of this design is that the downward dimension of the drive device 13 with respect to the drawing plane according to FIG. 50 is rather small, so that the pivot device 12 according to the invention can be employed also in low beds. Moreover, according to this embodiment a spring 39 is arranged which serves to provide a basic load. The provision of such a spring advantageously allows the entire drive device 13, i.e. the motor 14 and the gear transmission 15, to have comparatively small dimensions.

The above description is merely exemplary and shall not be limiting in any way. Accordingly, it can be provided for instance that the pivoting device according to the invention not only includes a single motor. It can also include two motors, for instance in the form of a double motor. This is beneficial for the provision of the required adjustment force, especially in oversize beds.

A further embodiment is illustrated in the FIGS. 51 to 60.

Figure 51:
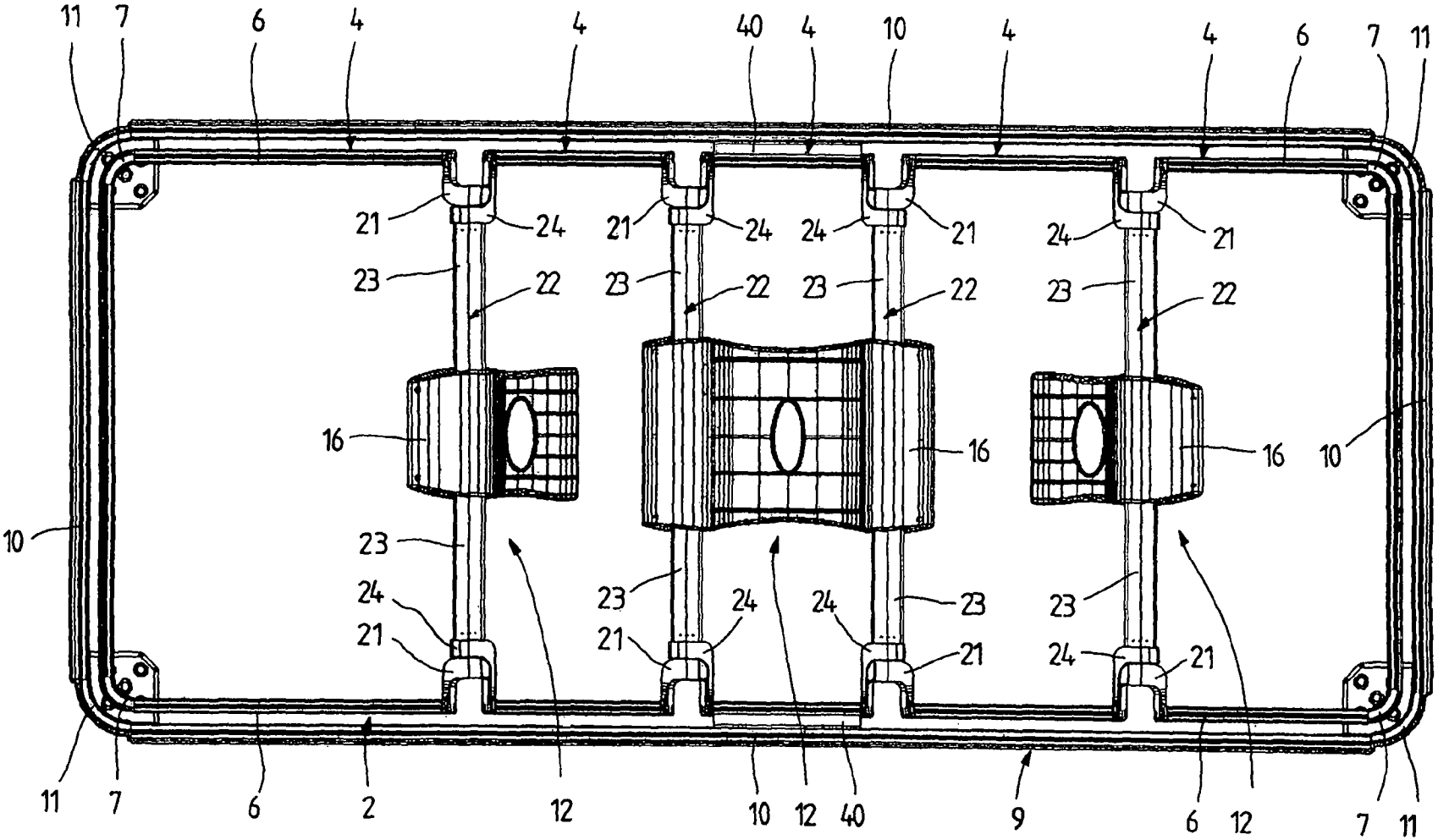
Figure 52:
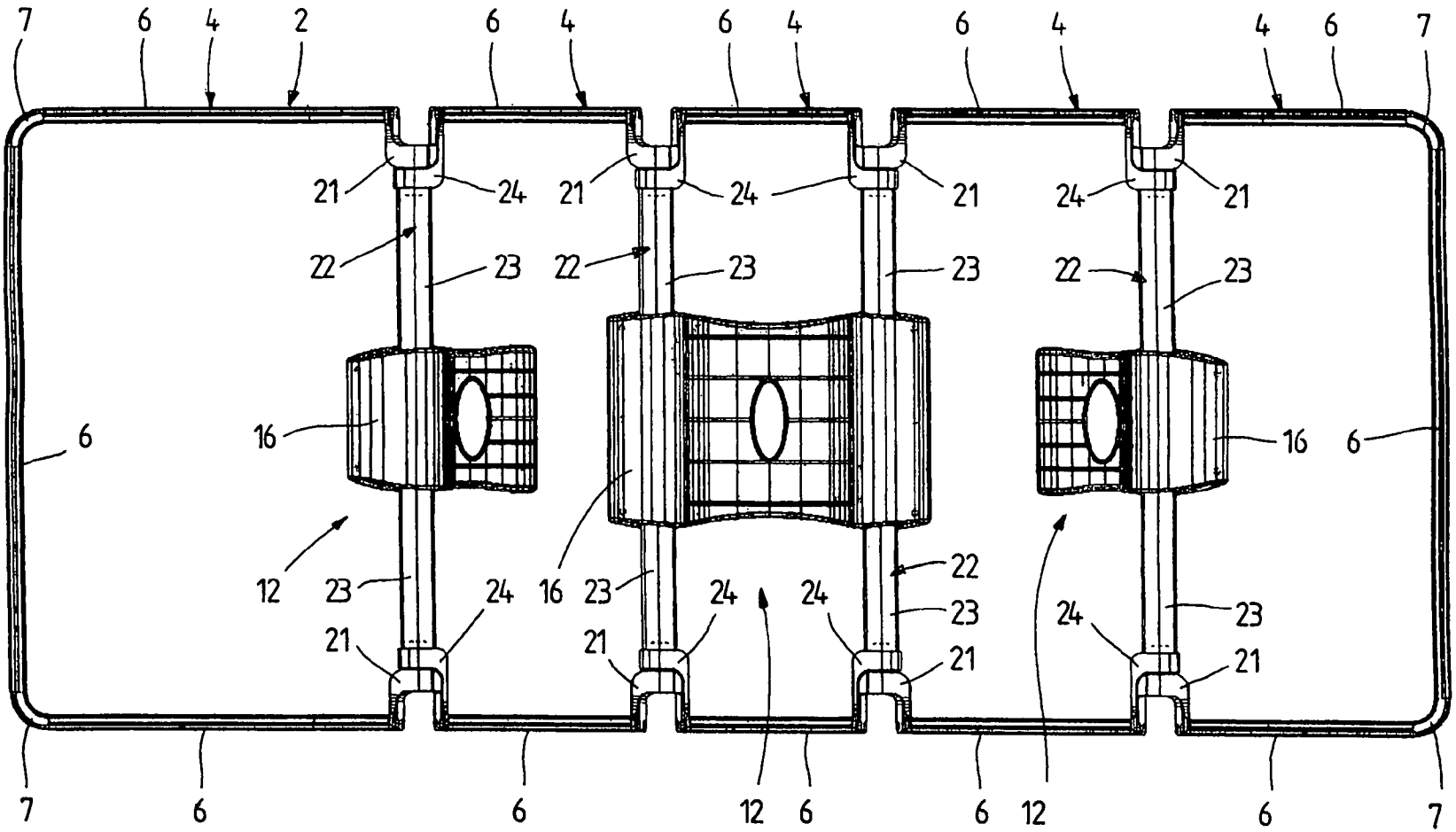
Figure 53:
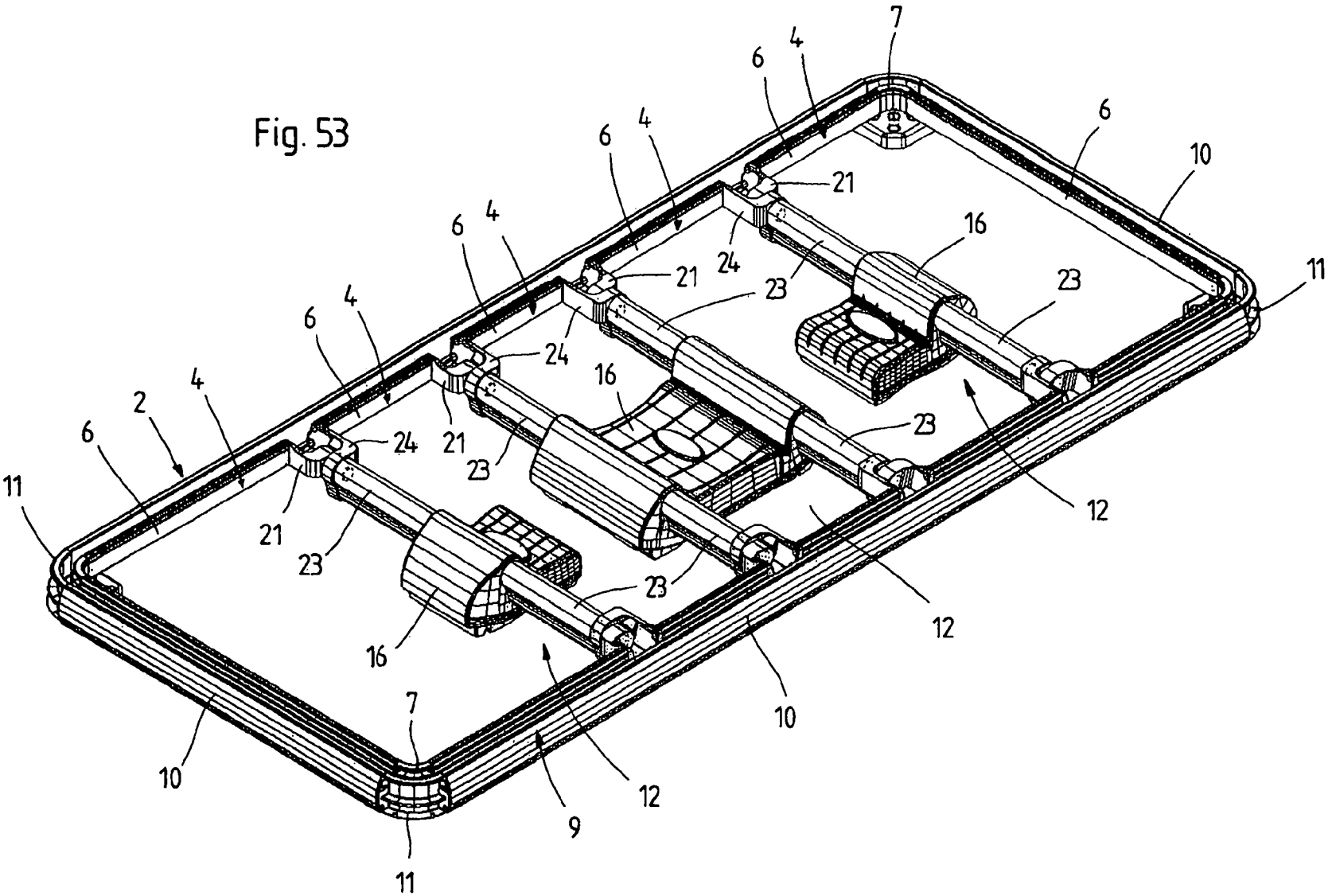

From the illustration according to the FIG. 51 is can be seen that also in this embodiment a bearing construction 2 is provided which is comprised of individual segments 4. The bearing construction 2 is supported by a supporting frame 9 in the manner which has already been described.

The distinctive feature of this embodiment according to the FIGS. 51 to 60 are the five segments which are provided for pivoting in relation to one another, wherein three segments 4 are coupled to each other via a common pivoting device 12.

Figure 54:
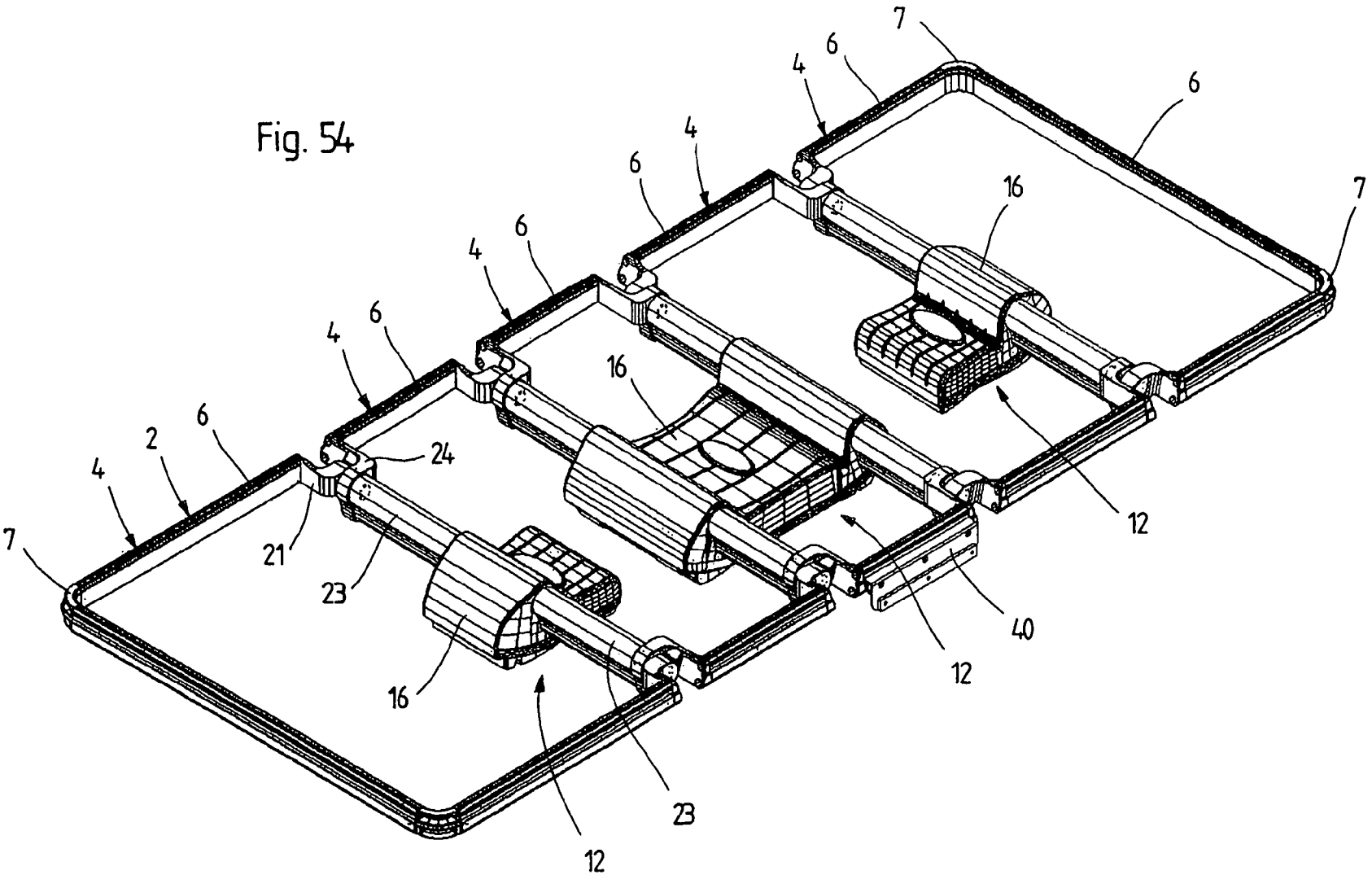
Figure 55:
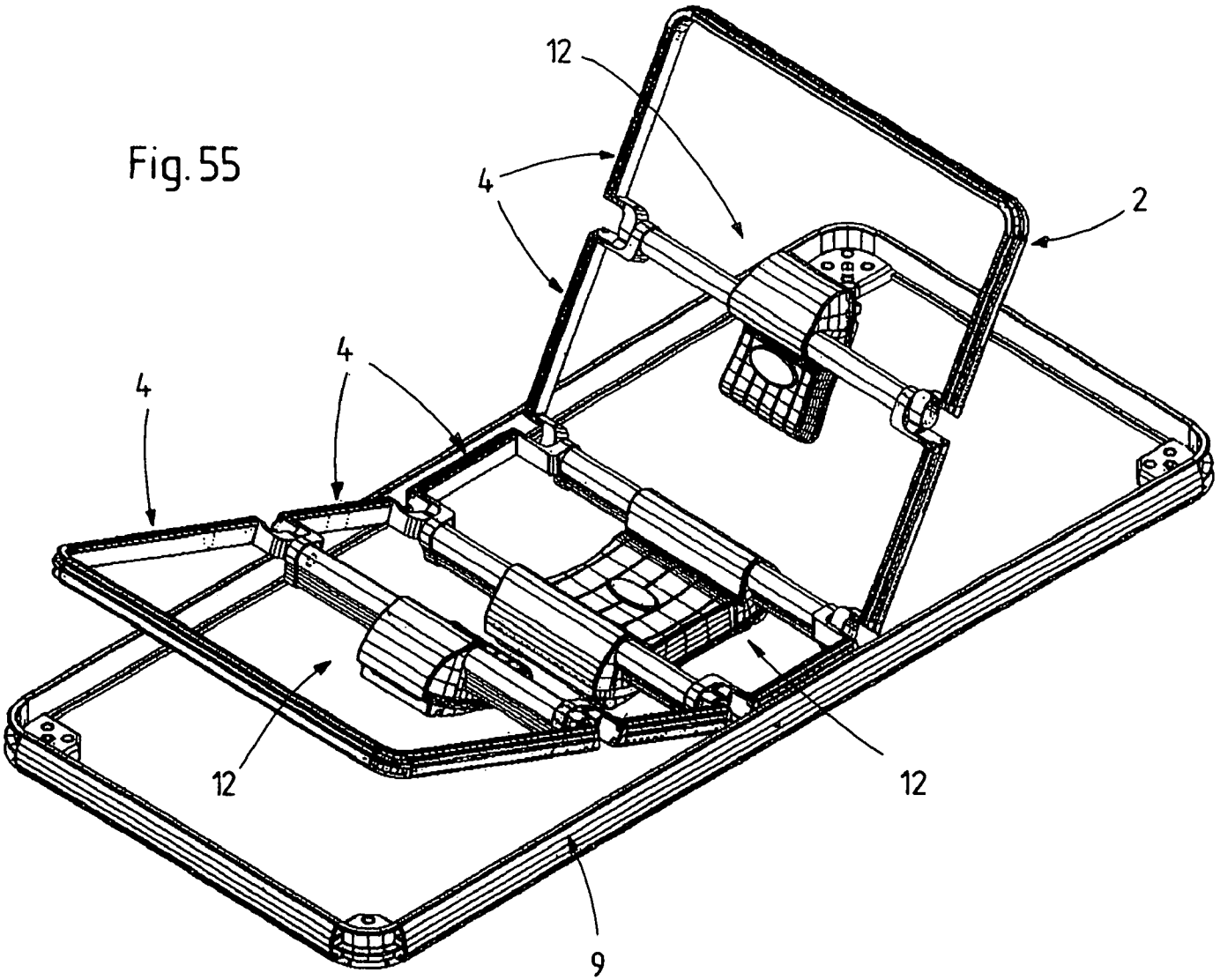
Figure 56:
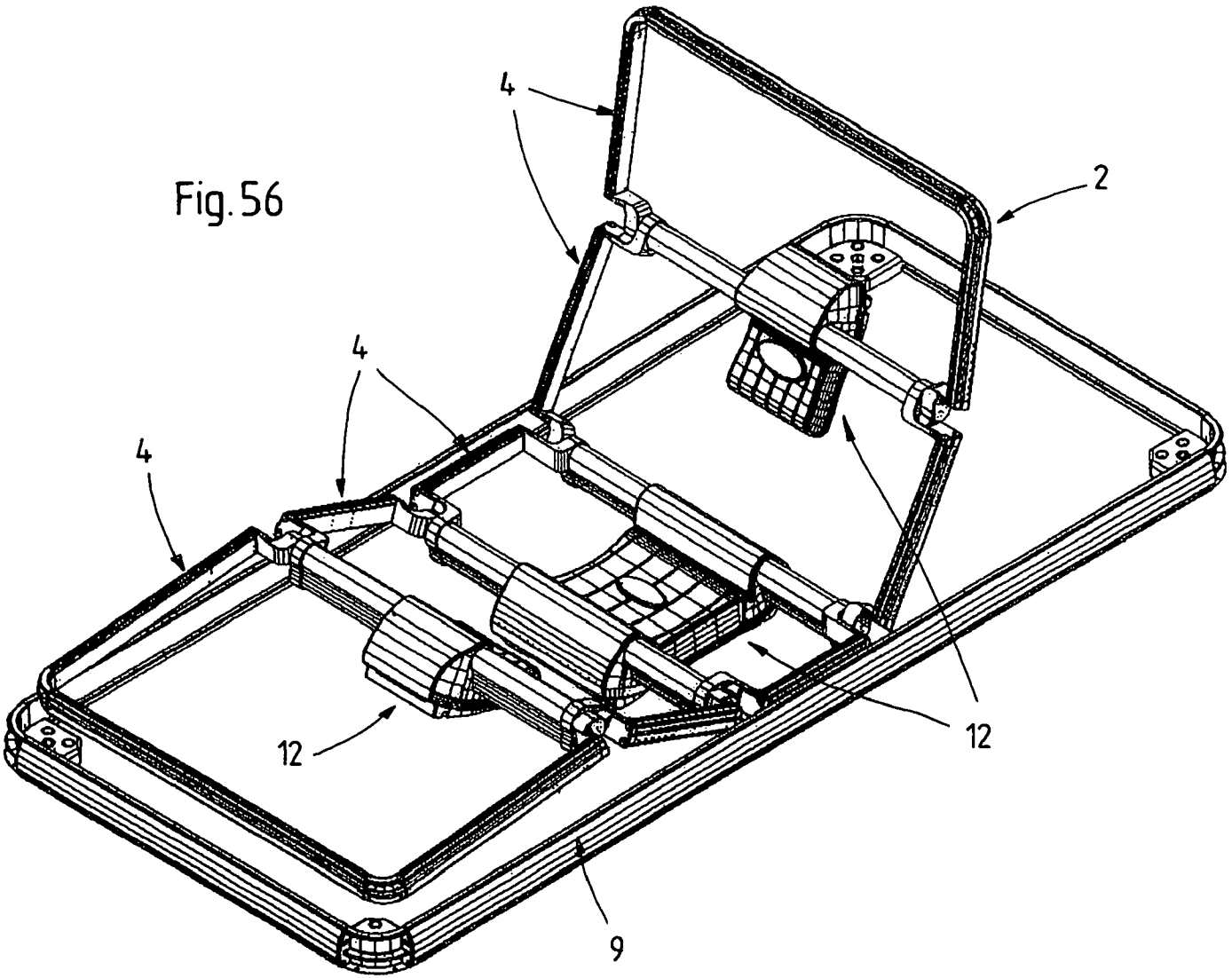
Figure 57:
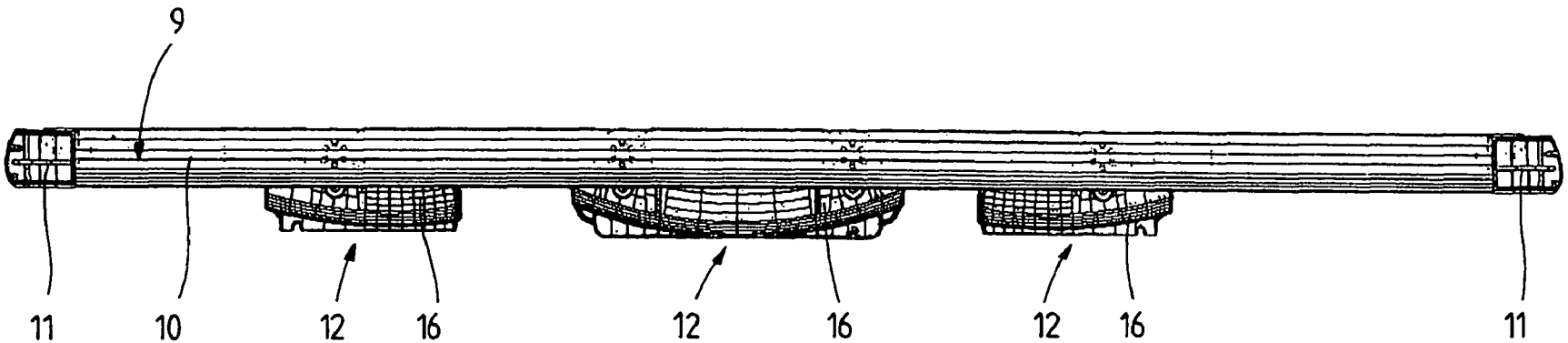

As can be learnt especially from the FIGS. 51 and 54, the bearing construction 2 includes a central segment 4 which in its finally mounted state is arranged on the supporting frame 9 by means of two connecting rails 40 and in a stationary fashion, which means that the central segment 4 is not relatively pivotable with respect to the supporting frame 9.

The central segment 4 is joined by two additional segments to its left and to its right with respect to the drawing plane according to FIG. 51. The segments 4 which are arranged adjacent to the central segment 4 are movable relative to this central segment 4. The segments 4 arranged adjacent to the left side and the right side of the movable segments with respect to the drawing plane according to FIG. 51 are again arranged for movement relative to the movable segments 4. The adjustability of the bearing construction 2 which results from the movable arrangement of the segments 4, i.e. the adjustability of the individual segments 4 relative to one another, are shown by way of an example in the FIGS. 55, 56 and 58 to 60, wherein the FIG. 60 merely illustrates the bearing construction 2, i.e. not the supporting frame 9 which supports the bearing construction in the finally mounted state.

Particularly the illustrations according to the FIGS. 51 to 54 show that the central segment 4 and the segments 4 which are arranged to the left and to the right of the central segment with respect to the drawing plane according to FIG. 51, are coupled to each other via a common pivoting device 12. This common pivoting device 12 provides a double drive which includes a motor on one side and two gear transmissions on the other side. One gear transmission serves to the one segment 4 arranged adjacent to the central segment 4, whereas the other gear transmission serves to the other segment 4 arranged adjacent to the central segment 4. As a result of this construction one motor can be saved, because due to the common pivoting device only one motor must be provided for totally three segments. This not only allows a low-cost design of the invention, but also easy handling and less mounting and maintenance work.

Figure 58:
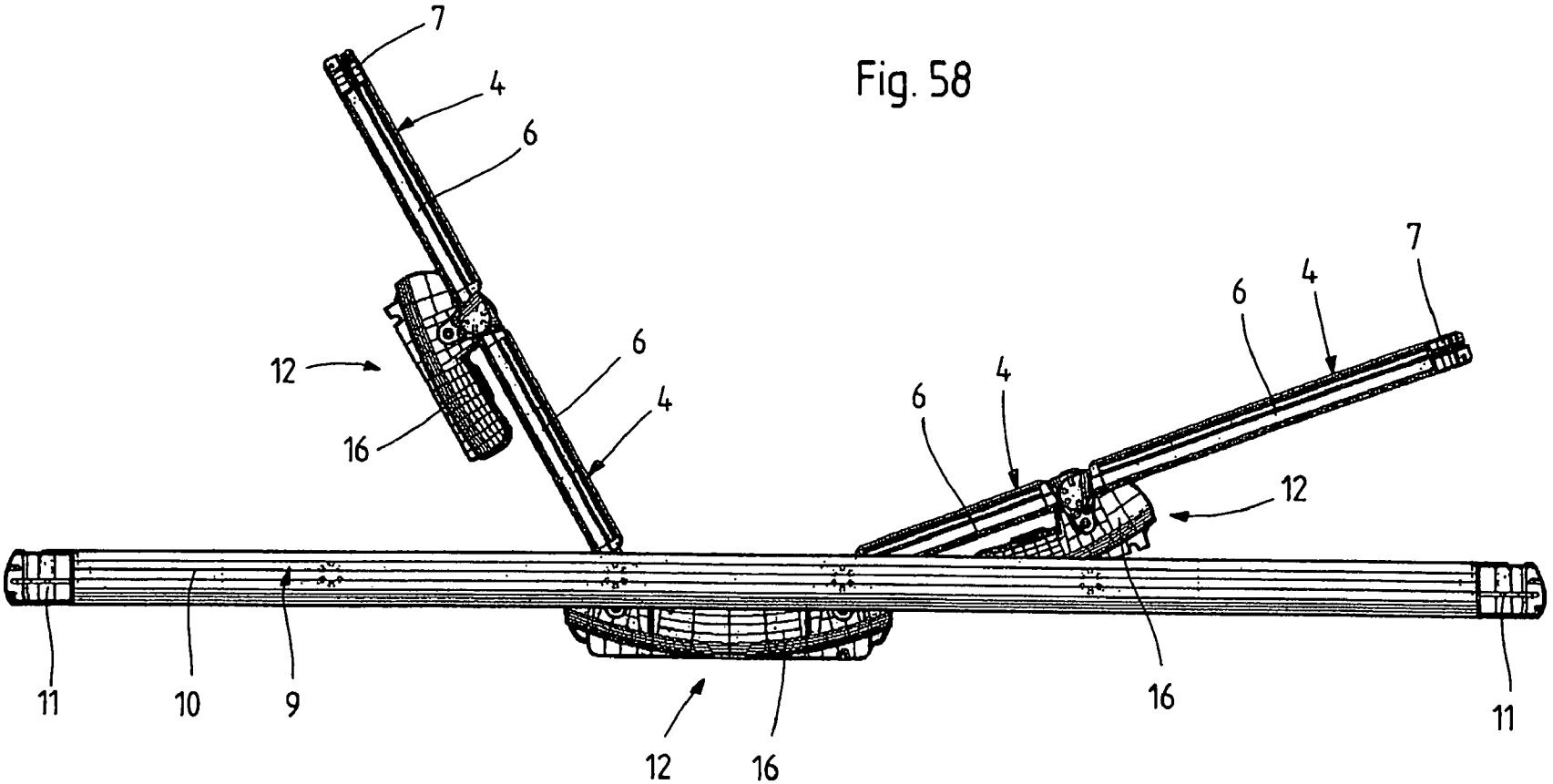
Figure 59:
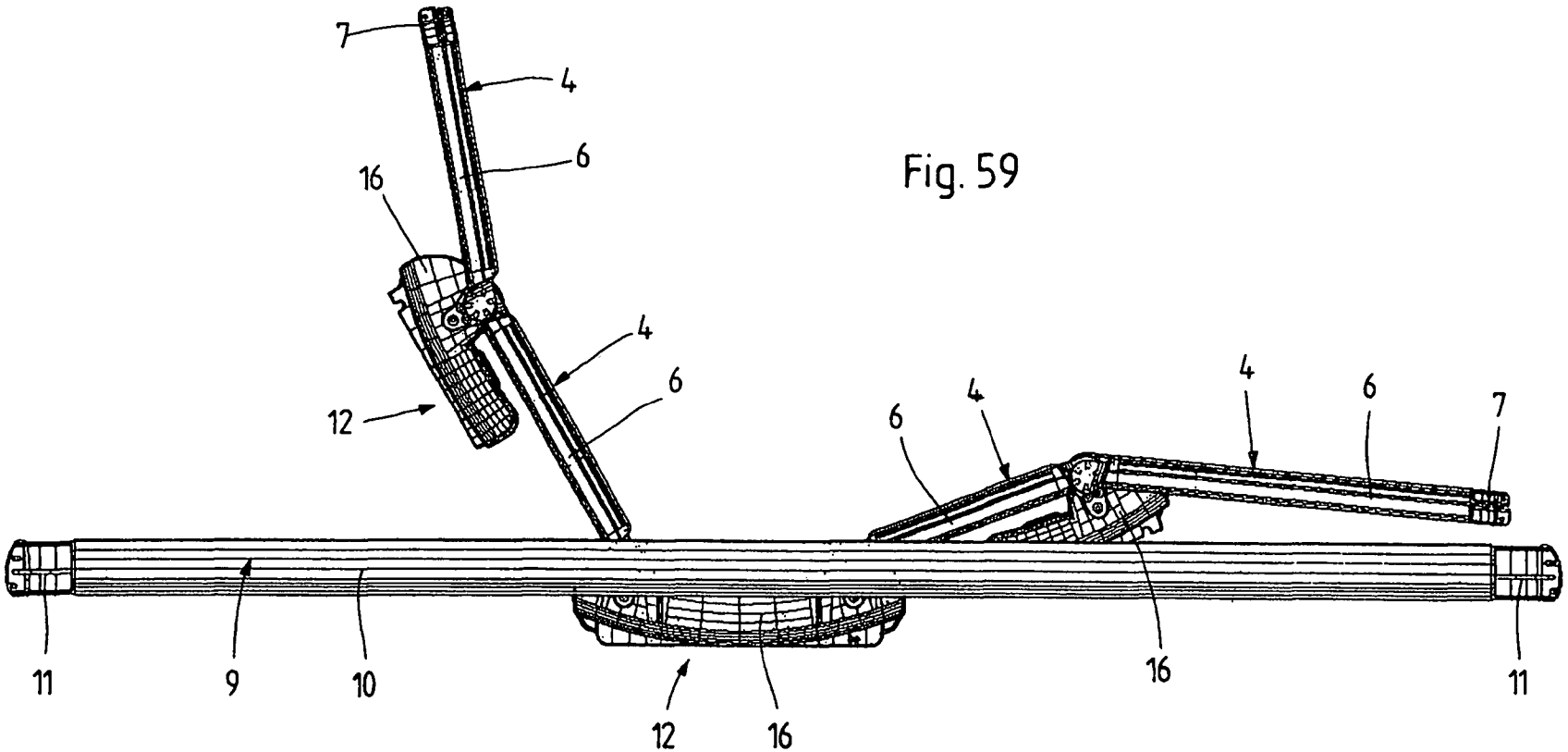
Figure 60:
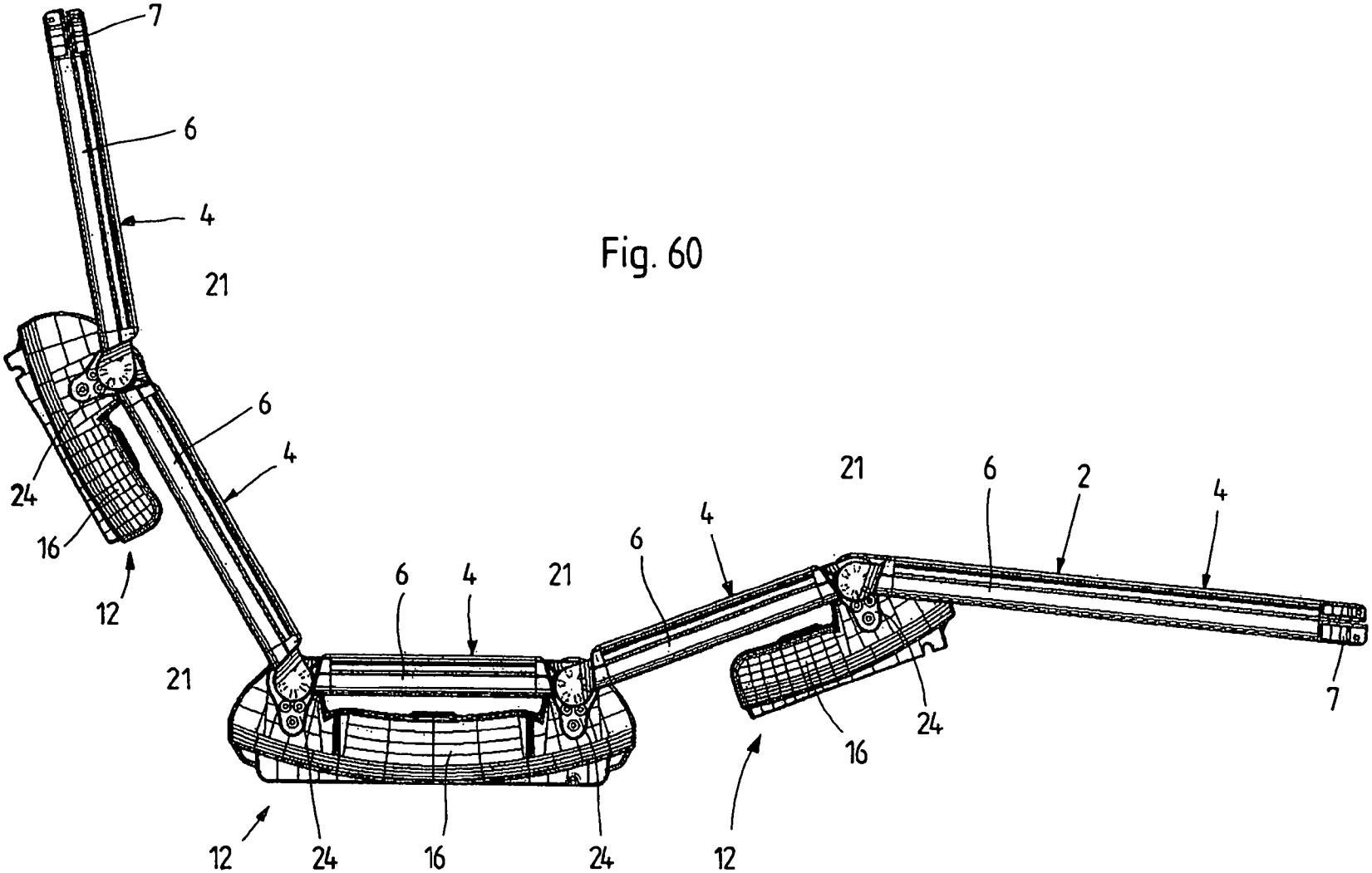

It can be clearly seen from the FIGS. 58 to 60 that the pivoting device according to the present invention requires a comparatively small installation space, so that a compact, space-saving overall construction is achieved which can be advantageously used also in low beds. Moreover, any connecting rods, cables or other connecting and coupling means extending under the bearing construction 2, i.e. under the individual segments 4, become unnecessary.

One embodiment of the invention employing a double motor at least for a pivoting device 12 is shown by the FIGS. 61 to 68. A pivoting device 12, for which a double motor can be used, is for instance the pivoting device 12 of a central segment 4, as this is shown by way of an example in the FIG. 51.

Figure 61:
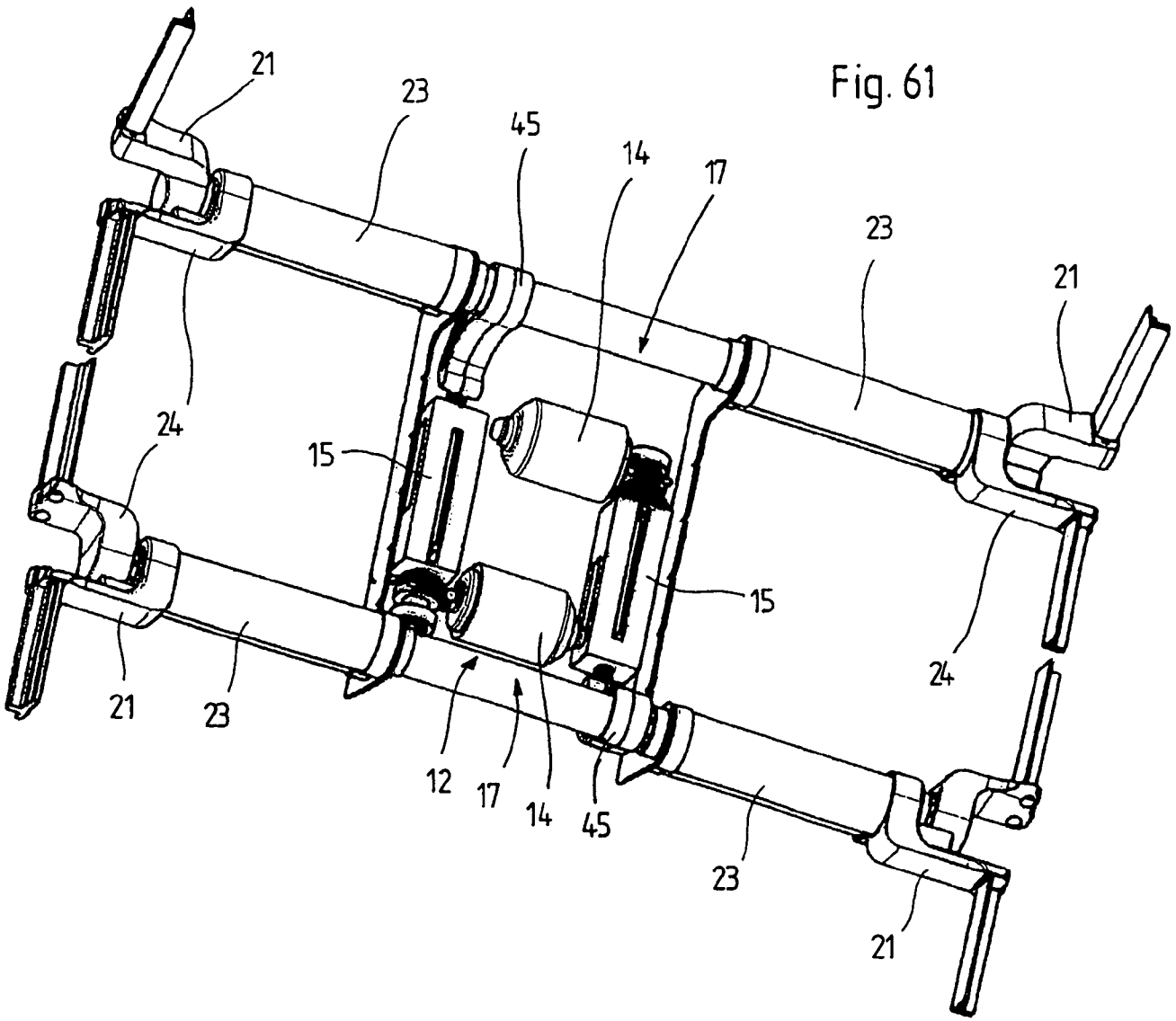
Figure 62:
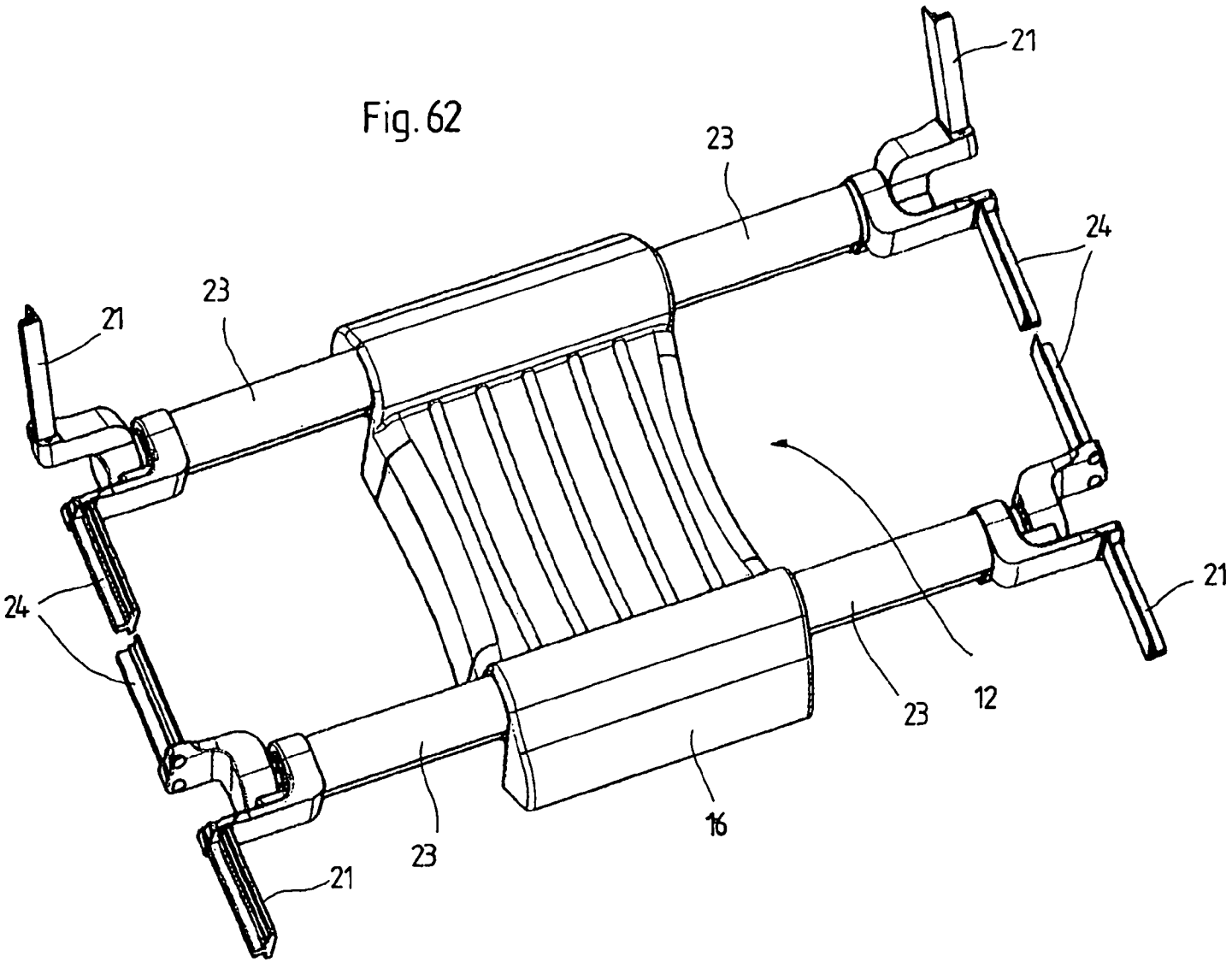
Figures 63, 64:
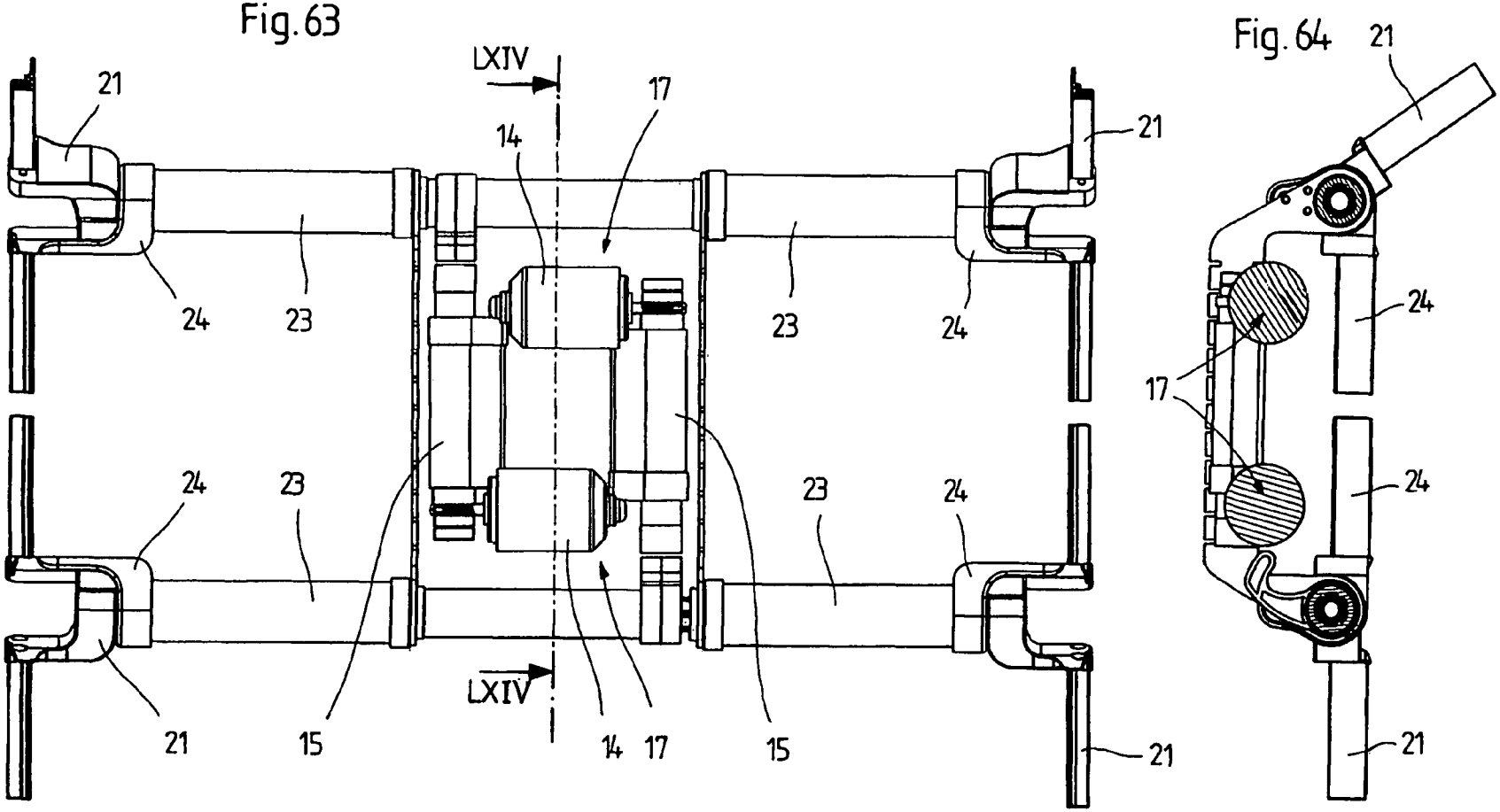
Figure 67:
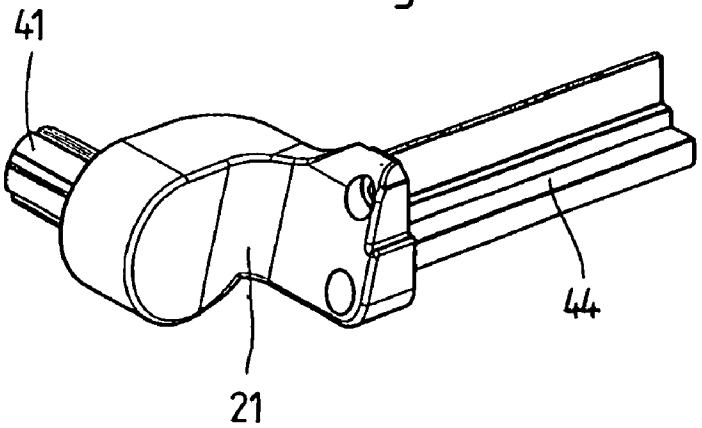
Figure 68:
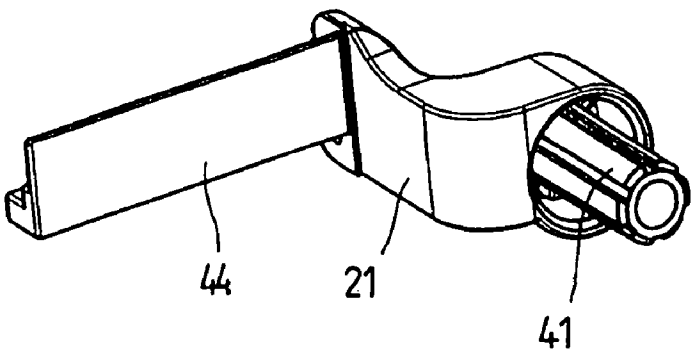

It can be seen particularly from FIG. 61 that the pivoting device 12 includes two motors 14. Each motor 14 is flanged to an associated gear transmission 15 which is connected in turn to an associated shaft 17 for power transmission. To transmit power between the gear transmission 15 on one side and the shaft 17 on the other side, an articulated lever 45 is used for example.

The FIGS. 65 and 66 or 67 and 68 illustrate a neck flange 24 or a fixing flange 21, respectively.

Figure 65:
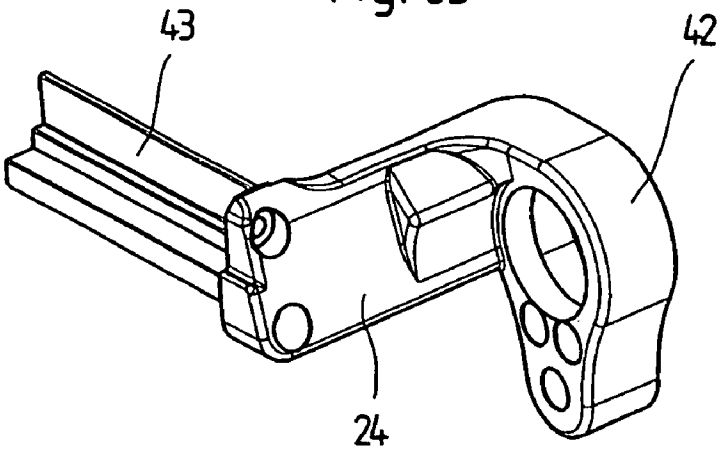
Figure 66:
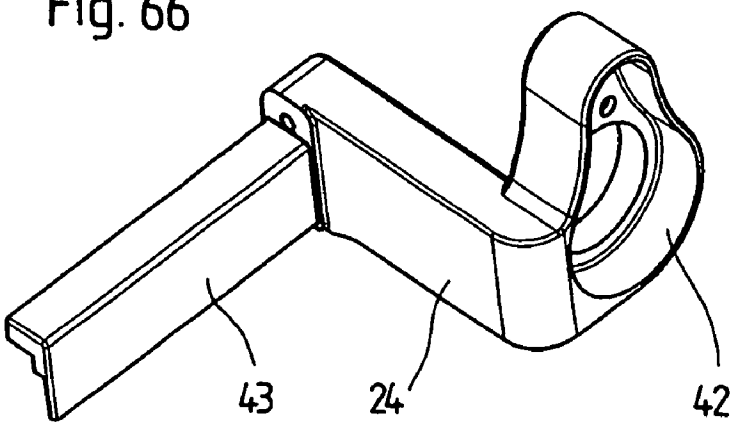

As it can be seen from the FIGS. 65 and 66, the neck flange 24 includes a connecting section 42 which is attached to the segment 23 of a bearing element 22 in the finally mounted state, as this is illustrated particularly by the FIG. 61. The neck flange 24 also includes an elbow part 43. This engages in a hollow frame part 6 of a segment 4 in the finally mounted condition, as this has already been explained above. Similarly, the fixing flange 21 includes an elbow part 44, as this can be seen from the FIGS. 67 and 68. In addition, a fixing flange comprises a shaft neck 41 which is also shown in the FIGS. 67 and 68. In the mounted state, the shaft neck 41 engages in the associated semi-shaft 18 or 19 of a shaft 17 in a power-transmitting fashion.

The invention claimed is:

1. A bed, such as for a hospital or nursing home, comprising:

a bearing construction configured to provide a bearing surface for a mattress, the bearing construction formed by segments that are pivotable relative to each other; and a pivoting device arranged between, and connected to, a first segment and a second segment of the bearing construction to pivot the first segment relative to the second segment, the pivoting device includes:

a drive device including a motor and a transmission;

a shaft flanged to the transmission, the shaft including a first semi-shaft and a second semi-shaft that are both within a common housing; and a supporting element that includes a first portion and a second portion, each of which are formed by the housing.

2. The bed of claim 1, wherein the first and the second semi-shafts each include a fixing flange operable to connect the first segment to the pivoting device.

3. The bed of claim 1, wherein the first portion and the second portion of the supporting element each include a neck flange operable to connect the second segment to the pivoting device.

4. The bed of claim 1, wherein the first segment and the second segment each include hollow frame parts.

5. The bed of claim 2, wherein the fixing flanges are web-shaped holders inserted in and fixed to hollow parts of a frame of the first segment to secure the first segment to the pivoting device.

6. The bed of claim 3, wherein the neck flanges are web-shaped holders inserted in and fixed to hollow parts of a frame of the second segment to secure the second segment to the pivoting device.

7. The bed of claim 1, wherein at least one of the first segment and the second segment are moveable on the pivoting device in a direction transverse to a longitudinal axis of the first semi-shaft and the second semi-shaft.

8. The bed of claim 1, wherein the drive device includes a drive housing that accommodates the motor and the transmission.

9. A bed, such as for a hospital or nursing home, comprising:

a first segment including:

a first mattress bearing surface; and a first frame defining a first hollow receptacle;

a second segment including:

a second mattress bearing surface; and a second frame defining a second hollow receptacle;

a pivoting device arranged between the first segment and the second segment, the pivoting device including:

a drive device including a motor and a gear transmission;

a shaft rotatable by the motor and transmission the shaft including a first semi-shaft and a second semi-shaft;

a first fixing flange extending from the shaft and secured within the first hollow receptacle to secure the first segment to the pivoting device; and a fixed bearer element housing both the first semi-shaft and the second semi-shaft, the fixed bearer element including a first neck flange extending therefrom, the first neck flange secured within the second hollow receptacle to secure the second segment to the pivoting device;

wherein activation of the drive device pivots the first segment relative to the second segment.

10. The bed of claim 9, wherein the first frame surrounds the first mattress bearing surface and the second frame surrounds the second mattress bearing surface.

11. The bed of claim 9, wherein the drive device is mounted to the fixed bearer element.

12. The bed of claim 9, wherein the first fixing flange extends from an end of the first semi-shaft, and a second fixing flange extends from an end of the second semi-shaft.

13. The bed of claim 9, wherein the first neck flange extends from a first end of the fixed bearer element and a second neck flange extends from a second end of the fixed bearer element.

14. The bed of claim 9, wherein the first neck flange is fixed.

15. The bed of claim 9, wherein the first segment is slidably movable along the first fixing flange.

16. A bed, such as for a hospital or nursing home, comprising:

a pivoting device including:

a drive device including a motor and a transmission;

a fixed bearing element;

a first neck flange and a second neck flange at opposite ends of the fixed bearing element;

a first semi-shaft and a second semi-shaft both housed within the fixed bearing element and extending from opposite sides of the drive device; and a first fixing flange at an end of the first semi-shaft and a second fixing flange at an end of the second semi-shaft;

a first segment including a mattress bearing surface and a pair of hollow receptacles, one hollow receptacle is in cooperation with the first fixing flange and the other hollow receptacle is in cooperation with the second fixing flange; and a second segment including a mattress bearing surface and a pair of hollow receptacles, one hollow receptacle is in cooperation with the first neck flange and the other hollow receptacle is in cooperation with the second neck flange;

wherein activation of the motor rotates the first and the second semi-shafts, and the first and the second fixing flanges, to pivot the first segment relative to the second segment; and wherein the first neck flange and the second neck flange remain stationary during activation of the motor and rotation of the first and the second semi-shafts.

17. The bed of claim 16, wherein the fixed bearing element includes a housing, the first and the second semi-shafts are rotatably mounted within the housing.

18. The bed of claim 17, wherein the first neck flange and the second neck flange are both integral with the housing.

19. The bed of claim 17, wherein the drive device is mounted to the housing.

20. The bed of claim 16, wherein the first segment is slidably movable along the first and the second fixing flanges.

* * * * *